US007826787B2

(12) United States Patent
Hatakeyama et al.

(10) Patent No.: US 7,826,787 B2
(45) Date of Patent: Nov. 2, 2010

(54) PROTECTIVE-AGENT APPLYING DEVICE, PROCESS CARTRIDGE, AND IMAGE FORMING APPARATUS

(75) Inventors: Kumiko Hatakeyama, Kanagawa (JP); Toshiyuki Kabata, Kanagawa (JP); Masahide Yamashita, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/033,496

(22) Filed: Feb. 19, 2008

(65) Prior Publication Data

US 2008/0226365 A1 Sep. 18, 2008

(30) Foreign Application Priority Data

Mar. 12, 2007 (JP) ..... 2007-062512
Mar. 14, 2007 (JP) ..... 2007-065637
Mar. 14, 2007 (JP) ..... 2007-065707

(51) Int. Cl.
*G03G 21/00* (2006.01)

(52) U.S. Cl. ..... 399/346; 399/111; 399/297; 430/58.05

(58) Field of Classification Search ..... 399/346
See application file for complete search history.

(56) References Cited

U.S. PATENT DOCUMENTS 6,060,205 A * 5/2000 Takeichi et al. ..... 430/126.2
7,218,879 B2 5/2007 Enoki et al.
7,315,711 B2 1/2008 Ariizumi et al.
2001/0031411 A1* 10/2001 Kojima et al. ..... 430/58.05
2004/0165919 A1* 8/2004 Nishida ..... 399/346
2005/0169668 A1 8/2005 Koichi et al.
2005/0196193 A1* 9/2005 Tamoto et al. ..... 399/111
2006/0133872 A1* 6/2006 Sugiura et al. ..... 399/346
2008/0089726 A1 4/2008 Hatakeyama et al.
2009/0016769 A1 1/2009 Hatakeyama et al.

FOREIGN PATENT DOCUMENTS

JP 51-22380 7/1976
JP 2002-97483 4/2002
JP 2004-198662 7/2004
JP 2005-4051 1/2005
JP 2005-17469 1/2005
JP 2005-249901 9/2005
JP 2005-274737 10/2005

* cited by examiner

*Primary Examiner*—David M Gray
*Assistant Examiner*—Roy Yi
(74) *Attorney, Agent, or Firm*—Oblon, Spivak, McClelland, Maier & Neustadt, L.L.P.

(57) ABSTRACT

A protective-agent applying device that applies a protective agent mainly containing paraffin to a photosensitive element. The protective-agent applying device applies a protective agent to a surface of the photosensitive element in such a manner that when applying the protective agent for 10 minutes, the protective agent equal to or more than 0.5 μg/cm$^2$ adheres to the surface, and when applying the protective agent for 60 minutes, the protective agent equal to or less than 8 μg/cm$^2$ adheres to the surface.

9 Claims, 3 Drawing Sheets

PROTECTIVE-AGENT APPLYING DEVICE, PROCESS CARTRIDGE, AND IMAGE FORMING APPARATUS

CROSS-REFERENCE TO RELATED APPLICATIONS

The present application claims priority to and incorporates by reference the entire contents of Japanese priority documents, 2007-062512 filed in Japan on Mar. 12, 2007, 2007-065637 filed in Japan on Mar. 14, 2007 and 2007-065707 filed in Japan on Mar. 14, 2007.

BACKGROUND OF THE INVENTION

1. Field of the Invention

The present invention relates to a protective-agent applying device, a process cartridge, and an image forming apparatus.

2. Description of the Related Art

In conventional electrophotographic image forming apparatuses, an image is formed by subjecting a photosensitive element to a charging process, an exposure process, a developing process, and a transfer process. Electrical discharge products produced in the charging process remain on the surface of the photosensitive element, and non-transferred toner or toner components also remain on the surface of the photosensitive element after the transfer process. These products and non-transferred toner or toner components are removed from the photosensitive element through a cleaning process.

A rubber blade is generally used for the cleaning process. The rubber blade is inexpensive, simple in mechanism, and excellent in cleaning capability.

However, because the rubber blade removes residual materials from the surface of the photosensitive element as being pressed against it, there is large mechanical stress due to friction between the surface of the photosensitive element and a cleaning blade as the rubber blade. Therefore, the rubber blade is worn, and the surface layer of the photosensitive element or of an organic photosensitive element in particular is worn, which causes both lives of the rubber blade and the organic photosensitive element to be reduced.

Small-sized toner particles are increasingly used for image formation to meet demands for high image quality.

In the image forming apparatus using the small-sized toner particles, residual toner particles often pass through under the cleaning blade. Particularly, when dimensional accuracy of the cleaning blade or the assembly accuracy are insufficient or when the cleaning blade partly vibrates, much more of toner particles pass through under the cleaning blade, resulting in decrease in image quality.

Therefore, to extend the life of the organic photosensitive element and maintain high image quality over a long period, it is necessary to reduce degradation of a material due to friction and improve the cleaning capability.

Japanese Patent Publication No. S51-22380 discloses a technology for employing a method of supplying a metallic soap such as zinc stearate to the photosensitive element and forming a coating of lubricant on the surface thereof by a cleaning blade. This method is preferred because, by using the metallic soap, the lubricating capability on the surface of the photosensitive element is improved and friction between the photosensitive element and the cleaning blade can thereby be reduced. Thus, the cleaning performance can be improved for non-transferred toner.

Recently, on the other hand, alternating current (AC) charging tends to be used for the charging process. The AC charging is performed by using a charging roller or the like that is charged by superimposing an AC voltage on a direct current (DC) voltage.

The AC charging has excellent capabilities such as high uniformity of a charging potential on a photosensitive element, less occurrence of oxidized gas such as ozone and NOx, and minimization of a device. On the other hand, the AC charging has disadvantages such that positive/negative electrical discharge is repeated hundreds to thousands times per second between a charging unit and a photosensitive element according to frequencies of a DC voltage to be applied, which causes degradation of the surface layer of the photosensitive element due to a large number of electrical discharges, to be accelerated. To take a measure against the degradation, by applying the lubricant to the photosensitive element, the energy of the AC charging is first absorbed by the lubricant, so that the energy is difficult to reach the photosensitive element, and the photosensitive element is thereby protected.

The metallic soap is decomposed here by the energy of the AC charging, but this does not mean that the metallic soap is not completely decomposed to disappear. Fatty acid with a low molecular weight is produced at this time, which causes the frictional force between the photosensitive element and the cleaning blade to become high, and the toner components together with the fatty acid are caused to easily adhere to the photosensitive element in a film form. The resolution of an image is thereby easily reduced and at the same time the photosensitive element wears, which easily leads to uneven density. Therefore, a large amount of metallic soap is supplied to the photosensitive element so that the surface of the photosensitive element is immediately coated with the metallic soap even if the fatty acid is produced. However, even if the large amount of metallic soap is supplied to the photosensitive element, only part of the metallic soap actually adheres to the surface of the photosensitive element. Therefore, the most of the metallic soap supplied to the photosensitive element is transferred together with the toner or is removed together with waste toner. This results in early running out of the metallic soap, and thus the metallic soap has to be replaced with new one before the end of useful life of the photosensitive element.

A lubricant as a protective agent instead of the metallic soap is described in, for example, Japanese Patent Application Laid-open No. 2005-274737, in which by using a lubricant supplying device that supplies a lubricant containing higher alcohol as a main component having a carbon number from 20 to 70, the higher alcohol stays at an edge of a blade nip as amorphous particles and this causes the surface of an image carrier (photosensitive element) to become appropriately wet, and thus lubricating capability is continued.

The lubricant based on the higher alcohol is easy to wet the surface of the photosensitive element and the effect as the lubricant can be expected. However, an area occupied by each of higher alcohol molecules absorbed in the image carrier tends to increase, and the density of molecules absorbed in the image carrier per unit area (weight of absorbed molecules per unit area) is low. Consequently, the photosensitive element is difficult to be protected from electrical stress due to the AC charging.

Japanese Patent Application Laid-open No. 2002-97483 describes that by using particular powder of alkylene bis-alkyl acid amide compound as a lubricating component, there exist powdery particles on an interface where a cleaning blade and an image carrier are pressed against each other, which allows smooth lubricating effect to be maintained over a long period of time.

However, the lubricant containing nitrogen atoms in molecules produces an ionic dissociating compound as a decomposed product like a nitrogen oxide and an ammonium-containing compound when the lubricant itself is exposed to the electrical stress due to the AC charging. And the ionic dissociating compound is taken into a lubricant layer and the resistance of the lubricant layer is reduced under high humidity, which may cause image blur to occur.

Furthermore, it is getting clearer that the protective agent containing paraffin as a main component can protect the photosensitive element from the electrical stress due to the AC charging and reduce the frictional force between the photosensitive element and the cleaning blade, and that the cleaning performance of the waste toner becomes extremely better. Particularly, even if the protective agent containing paraffin as a main component is oxidized by the stress due to the AC charging, fatty acid is not produced much, and the frictional force between the photosensitive element and the cleaning blade changes very slightly, which is preferable.

However, when the protective agent containing paraffin as a main component is used to repeatedly form images, an image may sometimes be defective, which is thought due to wear of the photosensitive element and the cleaning blade. Especially, the probability of occurrence of defective images largely changes depending on manufacturing lots of protective-agent applying devices.

Detailed examination was conducted on a location where a defective image was formed and a location where no defective image was formed. As a result, it is clear that the layer thickness of the photosensitive element decreases or much of the toner components adhere to the photosensitive element depending on in the location where a defective image with streaks is formed and in the location where no defective image is formed. However, examiners have no idea about what kind of factor causes these phenomena.

To extend organic photosensitive element life and to maintain high image quality over a long period of time, it is necessary to reduce deterioration of units due to friction and improve cleaning capability. For this purpose, as explained above, the method of supplying the metallic soap such as the zinc stearate to the photosensitive element and forming coating of the lubricant thereon by using the cleaning blade.

By applying the lubricant to the photosensitive element, the surface of the photosensitive element is protected by the lubricant. Thus, wear of the photosensitive element due to the friction between the cleaning blade and the photosensitive element is reduced, and degradation of the photosensitive element due to electrical discharge energy produced when the photosensitive element is charged is also reduced. Furthermore, by applying the lubricant, the lubricating capability of the surface of the photosensitive element is increased, which allows reduction of a phenomenon such that the cleaning blade partly vibrates and reduction of the amount of toner particles passing through under the cleaning blade. However, when the amount of applying the lubricant to the photosensitive element is too little, the lubricating capability and the protection performance are not satisfactorily effective in solving the problems on the wear of the photosensitive element, the degradation of the photosensitive element due to the AC charging, and the pass-through of toner particles. Therefore, the amount of the applied lubricant needs to be specified.

When zinc stearate is used for lubricant, the amount of the zinc stearate applied to the surface of the photosensitive element is evaluated using a ratio of zinc element to all the elements detected by X-ray photoelectron spectroscopy (XPS) analysis of the surface of the photosensitive element. Reference may be had to, for example, Japanese Patent Application Laid-open No. 2005-17469, Japanese Patent Application Laid-open No. 2005-249901, Japanese Patent Application Laid-open No. 2005-004051, and Japanese Patent Application Laid-open No. 2004-198662.

The XPS analysis allows detection of all the elements except for hydrogen on the extreme surface of a sample. Therefore, according to analysis of the surface of an organic photosensitive element with the zinc stearate applied thereto by using the XPS, an element ratio which the organic photosensitive element has is closer to an element ratio which the zinc stearate has with an increase in coverage of the zinc stearate. When the coverage reaches 100%, the element ratio of the organic photosensitive element theoretically coincides with the element ratio of the zinc stearate, and the amount of detected zinc is saturated. More specifically, when the zinc stearate ($C_{36}H_{70}O_4Zn$) covers the entire surface of the photosensitive element, a ratio of the zinc element to all the elements detected by the XPS based on the element ratio in molecules of the zinc stearate ($C_{36}H_{70}O_4Zn$) except for hydrogen becomes 2.44 atomic % in theory.

Therefore, the coverage $(Zn/2.44)\times100(\%)$ of the zinc stearate can be calculated from atomic % of the zinc. By using the coverage calculated by the amount of zinc in the above manner, it is possible to calculate a favorable coverage of the zinc stearate for improving the wear of the photosensitive element due to the cleaning blade, the pass-through of toner particles, and the degradation due to the AC charging.

A conventional method of evaluating whether application of a protective agent is satisfactory cannot be used depending on a lubricant to be used. More specifically, when a protective agent such as zinc stearate containing metal is used, the amount of metal can be used as an index of the coverage. However, when a protective agent such as paraffin not containing metal is used, peaks of the protective agent detected by the XPS analysis includes only peaks of C and O, and thus the protective agent cannot be separated from the elements contained in the photosensitive element, which makes it difficult to evaluate the amount of the protective agent deposited on the photosensitive element.

SUMMARY OF THE INVENTION

It is an object of the present invention to at least partially solve the problems in the conventional technology.

According to an aspect of the present invention, there is provided a protective-agent applying device. The protective-agent applying device includes an applying unit that applies a protective agent containing paraffin to a surface of a photosensitive element in such a manner that when applying the protective agent for 10 minutes, the protective agent equal to or more than 0.5 $\mu g/cm^2$ adheres to the surface, and when applying the protective agent for 60 minutes, the protective agent equal to or less than 8 $\mu g/cm^2$ adheres to the surface.

According to another aspect of the present invention, there is provided a process cartridge. The process cartridge includes a protective-agent applying device including an applying unit that applies a protective agent containing paraffin to a surface of a photosensitive element in such a manner that when applying the protective agent for 10 minutes, the protective agent equal to or more than 0.5 $\mu g/cm^2$ adheres to the surface, and when applying the protective agent for 60 minutes, the protective agent equal to or less than 8 $\mu g/cm^2$ adheres to the surface.

According to still another aspect of the present invention, there is provided an image forming apparatus. The image forming apparatus includes a protective-agent applying device including an applying unit that applies a protective agent containing paraffin to a surface of a photosensitive element in such a manner that when applying the protective agent for 10 minutes, the protective agent equal to or more than 0.5 μg/cm$^2$ adheres to the surface, and when applying the protective agent for 60 minutes, the protective agent equal to or less than 8 μg/cm$^2$ adheres to the surface.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
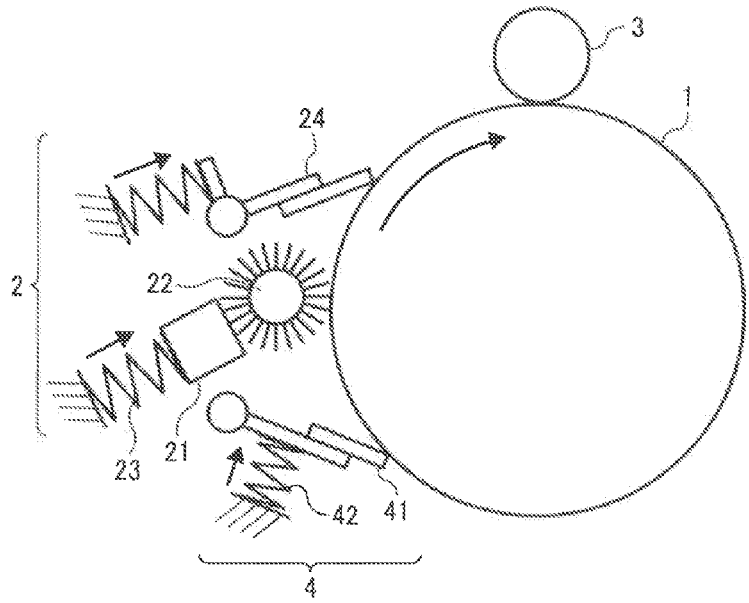
FIG. 1 is a schematic diagram of a protective-agent applying device according to a first embodiment of the present invention.

Exemplary embodiments of the present invention are explained in detail below with reference to the accompanying drawings.

Inventors of the present invention compared an amount of adhesion of protective agent to a photosensitive element for an image forming apparatus in which a defective image was formed with that for an image forming apparatus in which no defective image was formed, but could not find any particular difference therebetween.

Then, the inventors thought that occurrence mechanisms of defective images might be different from each other depending on formed images, and observed, in detail, locations where images were defective. As a result, it was found that when an image area of a formed image is small, toner components often adhere to the photosensitive element, and the resolution of the image thereby often decreases, while when an image area of a formed image is large, the photosensitive element partially wears, which likely causes a defective image.

As explained above, the ways of occurrence of defective images are different depending on formed images, and thus the inventors thought that the applied states of the protective agent might be different on the photosensitive element before image formation. Then, the applied states were observed by using an optical microscope or an electronic microscope. As a result, it was found that there is a difference between the applied states of the protective agent.

The inventors thought that there might be a difference in the amount of adhesion of the protective agent to the photosensitive element between a protective-agent applying devices for an image forming apparatus in which a defective image was formed and for an image forming apparatus in which no defective image was formed, and checked about the difference. As a result, it was found that there is a great difference in the adhesion amount of the protective agent between the individual applying devices.

More specifically, when the protective agent containing paraffin as a main component is applied to the photosensitive element by the protective-agent applying device, the adhesion amount of the protective agent is increasing as the applying time passes. However, in the protective-agent applying device in which no defective image is formed, the adhesion amount of the protective agent rapidly increases in a short period of time, thereafter, the increase becomes smooth, and the adhesion amount finally becomes a substantially constant value. On the other hand, in the protective-agent applying device in which a defective image is formed, the adhesion amount continues to smoothly increase with the applying time.

When the protective agent is applied by the protective-agent applying device for a long time, the surface of the photosensitive element with the protective agent applied thereto by the protective-agent applying device of the image forming apparatus in which no defective image is formed is comparatively smooth. On the other hand, the surface of the photosensitive element with the protective agent applied thereto by the protective-agent applying device of the image forming apparatus in which a defective image is formed is quite irregular, and thus there are locations where the protective agent thickly adheres to the photosensitive element and where almost no protective agent adheres thereto.

From these facts, in the protective-agent applying device of the image forming apparatus in which a defective image is formed, it takes time until the protective agent is satisfactorily applied to the photosensitive element, and thus it is clear that there is low effect to protect the photosensitive element from the electrical stress due to the AC charging in association with the image formation or from the mechanical stress due to the cleaning blade. Furthermore, it is clear that a location where much of the protective agent partially adheres to the photosensitive element appears through repeated image formation and that a defective image with streaks is easily recognized in the location.

The inventors have studied on a protective-agent applying device which is free from any defective image. The protective-agent applying device applies the protective agent containing paraffin as a main component to the photosensitive element, in which application conditions are set so that the adhesion amount of the protective agent is equal to or more than 0.5 μg/cm$^2$ when the protective agent is applied to the photosensitive element for 10 minutes and the adhesion amount thereof is equal to or less than 8 μg/cm$^2$ when the protective agent is applied thereto for 60 minutes.

When the protective agent is applied for 10 minutes, the adhesion amount of the protective agent in the protective-agent applying device is 0.5 μg/cm$^2$ or more, preferably in a range of 0.6 μg/cm$^2$ to 8 μg/cm$^2$, and more preferably in a range of 0.7 μg/cm$^2$ to 7 μg/cm$^2$. If the adhesion amount of the protective agent upon application for 10 minutes is less than 0.5 μg/cm$^2$, then the photosensitive element cannot be protected from the electrical stress due to the AC charging at the initial stage of the image formation and from the mechanical stress due to the cleaning blade.

Therefore, the location not coated with the protective agent is degraded significantly, and even if image formation is repeated, the protective agent is difficult to be deposited on the degraded location. Thus, the degradation further progresses, which may easily cause defective images at an early time. Furthermore, when small-sized and spherical toner particles are used to form images, remaining toner after an image is transferred is not satisfactorily cleaned, which also easily causes defective images.

When the protective agent is applied for 60 minutes, the adhesion amount of the protective agent in the protective-agent applying device is 8 $\mu g/cm^2$ or less, preferably in a range of 0.5 $\mu g/cm^2$ to 7.5 $\mu g/cm^2$, and more preferably in a range of 0.6 $\mu g/cm^2$ to 7 $\mu g/cm^2$. If the adhesion amount of the protective agent upon application for 60 minutes exceeds 8 $\mu g/cm^2$, then a location where the protective agent is unevenly deposited is produced. Because charge transfer is inhibited in the location, the sensitivity of the photosensitive element decreases, causing a defective image with streaks to easily appear, which is not preferred.

It is preferable that the protective agent covers over the surface of the photosensitive element at an early stage and the coverage is saturated to be constant under normal circumstances. In actual image formation, the protective agent supplied to the photosensitive element is pressed and spread by toner or the like, or is separated together with the toner from the photosensitive element. Therefore, an actual adhesion amount of the protective agent changes according to a toner supply amount or an image-area ratio. However, the protective-agent applying device prevents occurrence of defective images upon formation of images having an ordinary image-area ratio.

Examples of a method of measuring the adhesion amount of the protective agent on the photosensitive element of the protective-agent applying device are mass spectrometry, Fourier transform infrared (FT-IR) spectroscopy, and nuclear magnetic resonance (NMR) spectroscopy. By combining any one of the methods with gas chromatography or liquid chromatography, samples can be analyzed while being separated. Among these, the mass spectrometry is the most preferable method as a method of quantitatively determining the amount of paraffin. In the mass spectrometry, when a sample is ionized, it is usually ionized by electron impact spectroscopy, to quantitatively determine the generated ions.

However, in the electron impact spectroscopy, the molecules are decomposed, so that it is difficult to accurately analyze mass of the sample and therefore the ions are quantitatively determined based on experiences. On the other hand, in an ion attachment mass spectrometer (IAMS) (Vacuum, vol. 44, p. 655 (2001)), lithium is added to a sample in an extremely smooth state and the sample is ionized, and thus the molecules of the sample are hardly destroyed. Consequently, the sample can thereby be analyzed as a molecular weight in which an atomic weight of the lithium is added to the molecular weight of the substance. Particularly, paraffin as an artificial product and a natural product has a molecular weight distribution, and thus a method of quantitatively determining the molecular weight using the IAMS is preferable.

The photosensitive element on which the adhesion amount of the protective agent has been measured by the method is broken, and it cannot be used any more. However, in protective-agent applying devices of a manufacturing lot under the same conditions, it can also be thought that if the application conditions are the same, the individual application amounts of the protective agent are equivalent to each other. However, even if the conditions are the same, the adhesion amount of the protective agent changes depending on a manufacturing lot of a material to be used. Therefore, the change may often cause defective images upon image formation, and thus it is preferably checked in each same manufacturing lot whether the manufactured protective-agent applying device can maintain that the adhesion amount of the protective agent falls within the range.

The protective agent for the protective-agent applying device contains paraffin as a main component.

The protective agent used for a protective-agent bar of the protective-agent applying device contains paraffin as the main component whose melting point is in a range of 50° C. to 130° C., preferably 60° C. to 125° C., and more preferably 70° C. to 120° C. If the melting point of the paraffin is 60° C. or lower, the paraffin is easily deformed caused by its storage under high temperature, while if the melting point of the paraffin is 150° C. or higher, application performance of the paraffin to the photosensitive element significantly decreases, which is not preferred. The melting point of the paraffin indicates a temperature of an endothermic peak due to melting of the paraffin when the temperature is increased (e.g., temperature-increasing speed: 10° C./min) using Differential Scanning Calorimeter (for example, DSC-60 manufactured by Shimadzu Corp.).

Examples of the paraffin used for the protective agent are normal paraffin and isoparaffin. The paraffin may be used singly or may be used in combination of different types of paraffin.

The rate of the paraffin in the protective agent is in a range of 20 wt % to 95 wt %, preferably 40 wt % to 93 wt %, and more preferably 50 wt % to 90 wt %. If the rate of the paraffin is less than 20 wt %, then it is not preferable because the function as the protective agent is low and the photosensitive element is easily worn upon image formation. If the rate of the paraffin exceeds 95 wt %, then it is difficult to cover the surface of the photosensitive element with the paraffin, which is not preferred. If the paraffin is used singly, it is quite difficult to be spread into a thin film over the photosensitive element by using only the pressure of a brush or a blade. Consequently, it is inevitable that the paraffin is mixed with other materials upon use thereof.

Furthermore, examples as materials other than the paraffin used for the protective-agent bar include an amphiphilic organic compound, and a hydrocarbon group which is classified into aliphatic unsaturated hydrocarbon, alicyclic saturated hydrocarbon, alicyclic unsaturated hydrocarbon, and aromatic hydrocarbon. In addition to the hydrocarbon group, the examples also include fluororesin and fluoro wax group such as polytetrafluoroethylene (PTFE), polyperfluoroalkylether (PFA), perfluoroethylene-perfluoropropylene copolymer (FEP), polyvinylidene fluoride (PVdF), and ethylene-tetrafluoroethylene copolymer (ETFE); silicone resin and a silicone wax group such as polymethylsilicone and polymethylphenylsilicone; and an inorganic compound such as mica having lubricating capability. The examples are not limited by these materials, however, particularly preferable ones among these are the amphiphilic organic compound and the alicyclic saturated hydrocarbon. Because by containing these materials in the protective agent, the application performance of the protective agent is improved, and the photosensitive element can be thinly coated with the protective agent containing the alicyclic saturated hydrocarbon such as cyclic polyolefin in particular. These compounds except for paraffin may be used singly or as a mixture of various types of the compounds.

Examples of the alicyclic saturated hydrocarbon include cycloparaffin and cyclic polyolefin.

The amphiphilic organic compound is classified into an anionic surfactant, a cationic surfactant, a zwitterionic surfactant, a nonionic surfactant, and a compound thereof. The protective agent is required to prevent a bad influence from being exerted upon the electrical property of the image carrier to form the protective agent and perform an imaging process. When the nonionic surfactant is used as the amphiphilic organic compound, there is no ionic dissociation in the surfactant itself. Therefore, even if the use environment, particularly, humidity largely changes, charge leakage due to aerial discharge can be suppressed, and high image quality can be maintained. Furthermore, the nonionic surfactant is preferably an esterified product of an alkyl carboxylic acid and a polyalcahol group based on Formula (1) as follows:

[Formula 1]

$$C_nH_{2n+1}COOH \quad (1)$$

where n is an integer of 15 to 35.

By using a straight-chain alkyl carboxylic acid as an alkyl carboxylic acid of Formula (1), a hydrophobic portion of the amphiphilic organic compound is easily arrayed on the surface of the image carrier where the amphiphilic organic compound is adsorbed, and the adsorption density to the surface of the image carrier particularly increases, which is a preferable mode.

Alkyl carboxylate in one molecule shows hydrophobic property. If there is a larger number of alkyl carboxylates, it is more effective to prevent adsorption of a dissociated substance produced due to aerial discharge to the surface of the image carrier and to reduce the electrical stress to the surface of the image carrier in a charging area. However, if a proportion of the alkyl carboxylates occupied therein is too much, the portion of a polyalcohol group indicating hydrophilic property is hidden, and sufficient adsorption capability does not sometimes come out depending on the surface state of the image carrier. Therefore, the average number of ester bonds per molecule of the amphiphilic organic compound is preferably in a range of 1 to 3.

The average number of ester bonds per molecule of the amphiphilic organic compound can be also adjusted by selecting at least one type from a plurality of amphiphilic organic compounds having different number of ester bonds and combining the selected ones.

As explained above, examples of the amphiphilic organic compound include an anionic surfactant, a cationic surfactant, a zwitterionic surfactant, and a nonionic surfactant.

Examples of the anionic surfactant includes compounds containing anion at the end of a hydrophobic portion such as alkylbenzene sulfonate, α-olefin sulfonate, alkane sulfonate, alkyl sulfate, alkyl polyoxyethylene sulfate, alkyl phosphate, long-chain fatty acid salt, α-sulfo fatty acid ester salt, and alkyl ether sulfate; and bonding the anion to alkali metal ion such as natrium and kalium, alkali earth metal ion such as magnesium and calcium, metal ion such as aluminum and zinc, and ammonium ion.

Examples of the cationic surfactant include compounds containing cation at the end of a hydrophobic portion such as alkyltrimethyl ammonium salt, dialkyldimethyl ammonium salt, and alkyldimethyl benzyl ammonium salt; and boding the cation to chlorine, fluorine, bromine, phosphate ion, nitrate ion, sulfate ion, thiosulfate ion, carbonate ion, and hydroxy ion.

Examples of the zwitterionic surfactant include dimethylalkylamine oxide, N-alkylbetaine, imidazoline derivative, and alkyl amino acid.

Examples of the nonionic surfactant include alcohol compounds, ether compounds, and amido compounds such as long-chain alkyl alcohol, alkyl polyoxyethylene ether, polyoxyethylene alkyl phenyl ether, fatty acid diethanol amide, alkyl polyglucoxide, and polyoxyethylene sorbitan alkyl ester. Preferred examples thereof are long-chain alkyl carboxylic acid such as lauric acid, palmitic acid, stearic acid, behenic acid, lignoceric acid, cerotic acid, montan acid, and melissic acid; a polyalcahol group such as ethylene glycol, propylene glycol, glycerin, erythritol, and hexitol; and ester compounds of any of these and a partial anhydride.

More specific examples of the ester compounds include glyceryl alkylcarboxylate such as glyceryl monostearate, glyceryl distearate, glyceryl monopalmitate, glyceryl dilaurate, glyceryl trilaurate, glyceryl dipalmitate, glyceryl tripalmitate, glyceryl dimyristate, glyceryl trimyristate, glyceryl palmitate stearate, glyceryl monoarachidate, glyceryl diarachidate, glyceryl monobehenate, glyceryl stearate behenate, glyceryl cerotate stearate, glyceryl monomontanate, and glyceryl monomelissate, and substituted compounds thereof, sorbitan alkylcarboxylate such as sorbitan monostearate, sorbitan tristearate, sorbitan dipalmitate, sorbitan tripalmitate, sorbitan dimyristate, sorbitan trimyristate, sorbitan palmitate stearate, sorbitan monoarachidate, sorbitan monobehenate, sorbitan stearate behenate, sorbitan scerotate stearate, sorbitan monomontanate, and sorbitan monomelissate, and substituted compounds thereof, but the ester compounds are not limited thereto.

A single or a plurality kinds of these amphiphilic organic compounds may be used. Furthermore, a filler such as a metal oxide, a silicate compound, and mica may be contained in the protective agent depending on cases.

FIG. 1 is a schematic diagram of a protective-agent applying device 2 according to a first embodiment of the present invention. The protective-agent applying device 2 is arranged to face a drum-type image carrier 1 as a photosensitive element. The protective-agent applying device 2 includes a protective agent 21, a protective-agent supplying unit 22, a pressing-force imparting mechanism 23, and a protective-layer forming mechanism 24.

The protective agent 21 is pressed by the pressing-force imparting mechanism 23 against the protective-agent supplying unit 22 of, for example, a brush type. The protective-agent supplying unit 22 rotates with the rotation of the image carrier 1 based on a difference in linear velocity between the two so that the protective-agent supplying unit 22 slidably contacts the surface of the image carrier 1, and during the contact, the protective agent 21 on the surface of the protective-agent supplying unit 22 is supplied to the surface of the image carrier 1.

Materials of the blade used for the protective-layer forming mechanism are not particularly limited, and an elastic element generally known as a material for cleaning blade such as urethane rubber, hydrin rubber, silicone rubber, and fluoro rubber can be used singly or in a blended manner. These rubber blades may be subjected to coating or to a dipping process using any material with a low friction coefficient at a contact portion with the image carrier. To adjust the hardness of the elastic element, a filler such as any other organic filler or inorganic filler may be dispersed in the material.

Each of the blades is fixed to a blade support by using an arbitrary method such as bonding or fusion bonding so that the edge of the blade can be pressed to contact the surface of the image carrier. Although the thickness of the blade is not uniquely defined because it depends on a pressing force, if it is in a range of about 0.5 millimeter to 5 millimeters, the blade is preferably used, and if in a range of about 1 millimeter to 3 millimeters, then it can be more preferably used.

The length i.e. free length of the cleaning blade which protrudes from the blade support and allows deflection thereof is not also uniquely defined because it depends on the pressing force. However, if it is in a range of about 1 millimeter to 15 millimeters, the blade is preferably used, and if in a range of about 2 millimeters to 10 millimeters, then it can be more preferably used.

One of other configurations of the blade material for forming the protective agent is as follows. That is, a layer of resin, rubber, or elastomer may be formed on the surface of an elastic metal blade such as a spring plate via a coupling agent or a primer component if necessary using a method of coating or dipping, subjected to thermosetting if necessary, and further subjected to surface polishing as required.

If the thickness of the elastic metal blade is in a range of about 0.05 millimeter to 3 millimeters, the blade can be preferably used, and if in a range of about 0.1 millimeter to 1 millimeters, then it can be more preferably used. To prevent torsion of the elastic metal blade, the blade may be subjected to a process such as bending in a direction substantially parallel to a spindle after being fixed.

As a material to form the surface layer, fluororesin such as PFA, PTFE, FEP, and PVdF; and a silicone base elastomer such as fluororubber and methylphenyl silicone elastomer can be used together with the filler if necessary, however, the material is not limited by these materials.

The force to press the image carrier by the protective-layer forming mechanism is only required as force with which the protective agent is spread to be formed as a protective layer or a protective film. Therefore, as a linear pressure, a range of 5 gf/cm to 80 gf/cm is preferable, and a range of 10 gf/cm to 60 gf/cm is more preferable.

A brush type material is preferably used as a protective-agent supplying unit. However, in this case, to suppress mechanical stress to the surface of the image carrier, brush fibers preferably have flexibility.

As specific materials of the flexible brush fibers, one or more of types can be selected from among generally known materials. Specifically, any resin having flexibility of those as follows can be used: polyolefin resin such as polyethylene and polypropylene; polyvinyl and polyvinylidene resins such as polystyrene, acrylic resin, polyacrylonitrile, polyvinyl acetate, polyvinyl alcohol, polyvinyl butyral, polyvinyl chloride, polyvinyl carbazole, polyvinyl ether, and polyvinyl ketone; vinyl chloride-vinyl acetate copolymer; styrene-acrylic acid copolymer; styrene-butadiene resin; fluororesin such as polytetrafluoroethylene, polyvinyl fluoride, polyvinylidene fluoride, and polychloro-trifluoroethylene; polyester; nylon; acryl; rayon; polyurethane; polycarbonate; phenol resin; and amino resin such as urea-formaldehyde resin, melamine resin, benzoguanamine resin, urea resin, and polyamide resin.

Furthermore, to adjust the degree of deflection, those as follows may be used in a combined manner: diene rubber, styrene-butadiene rubber (SBR), ethylene propylene rubber, isoprene rubber, nitrile rubber, urethane rubber, silicone rubber, hydrin rubber, and norbornen rubber.

The support of the protective-agent supplying unit includes a fixed type and a rotatable roll type. One of roll-type supplying units is a roll brush obtained by spirally winding a pile type tape made from brush fibers around a core metal. The brush fibers having those conditions as follows are preferably used. That is, the diameter of the brush fiber ranges from about 10 micrometers to 500 micrometers, the length thereof ranges from 1 millimeter to 15 millimeters, and the density thereof ranges from 10,000 to 300,000 lines per square inch ($1.5\times10^7$ to $4.5\times10^8$ lines per square meter).

As the protective-agent supplying unit, it is preferable that a material with high brush density is used as possible as it can be, in terms of uniformity and stability when the protective agent is supplied. It is also preferable that one fiber is made from several to hundreds lines of fine fibers. For example, 50 fine fibers of 6.7 decitexes (6 deniers) are tied in a bundle, like 333 decitexes=6.7 decitexes×50 filaments (300 deniers=6 deniers×50 filaments), and the bundle as one fiber can be planted in the brush. However, the brush preferably has functions of supplying the protective agent to the photosensitive element, scraping again the protective agent from a portion where the protective agent is thickly deposited on the photosensitive element, and of making smooth the surface of the photosensitive element. Therefore, one fiber is more preferable than one fiber made of fine fibers.

A coating layer may be formed on the surface of the brush to stabilize the shape of the surface and environmental stability of the brush as required. As a component to form the coating layer, it is preferable to use a coating layer component capable of deforming according to the deflection of the brush fibers. Any material can be used if it can keep flexibility. Examples thereof are polyolefin resin such as polyethylene, polypropylene, chlorinated polyethylene, and chlorosulfonated polyethylene; polyvinyl and polyvinylidene resin such as polystyrene and acryl such as polymethyl methacrylate, polyacrylonitrile, polyvinyl acetate, polyvinyl alcohol, polyvinyl butyral, polyvinyl chloride, polyvinyl carbazole, polyvinyl ether, and polyvinyl ketone; vinyl chloride-vinyl acetate copolymer; silicone resin of organosiloxane bonding or its modified product of such as alkyd resin, polyester resin, epoxy resin, and polyurethane; fluororesin such as perfluoroalkyl ether, polyvinyl fluoride, polyvinylidene fluoride, and polychloro-trifluoroethylene; polyamide; polyester; polyurethane; polycarbonate; and amino resin such as urea-formaldehyde resin; epoxy resin; and composite resin of these materials.

Figure 2:
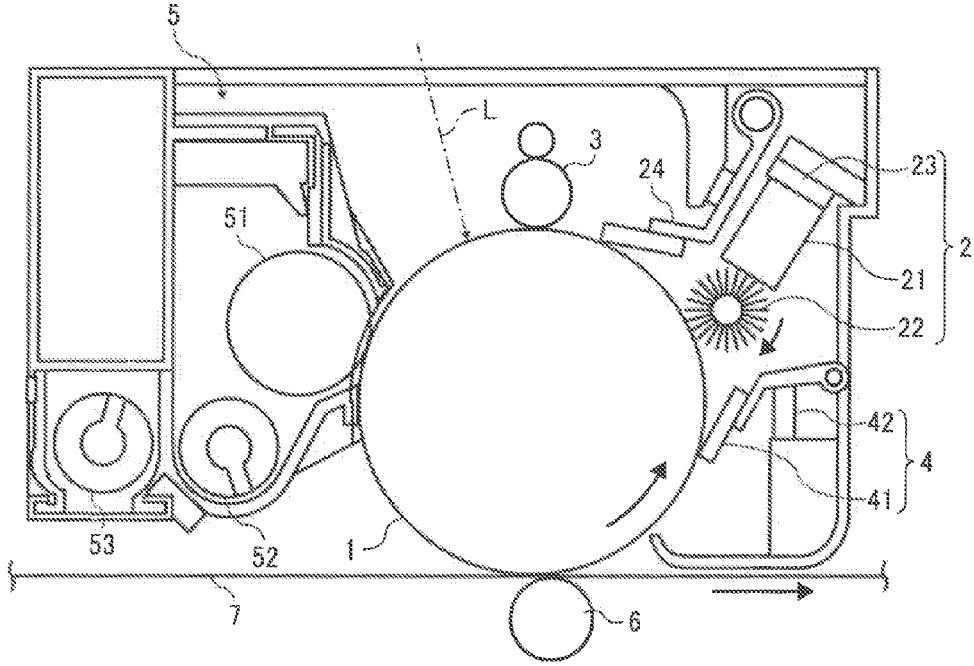
FIG. 2 is a schematic diagram of a process cartridge including the protective-agent applying.

FIG. 2 is a schematic diagram of a process cartridge to which is applied the protective-agent applying device 2.

The protective-agent applying device 2 is arranged to face the image carrier 1 as a photosensitive element. The protective-agent applying device 2 includes the protective agent (bar) 21, the protective-agent supplying unit 22, the pressing-force imparting mechanism 23, and the protective-layer forming mechanism 24.

The cleaning device 4 includes a cleaning unit 41 and a pressing-force imparting mechanism 42. On the surface of the image carrier 1, the protective agent and toner components partly degraded after the transfer process remain, but such residues on the surface are cleaned by the cleaning unit 41. In FIG. 2, the cleaning unit comes in contact with the surface at an angle to be contacted in the counter direction (leading type) with respect to the surface.

The residual toner and the degraded protective agent are removed from the surface of the image carrier 1, the protective agent 21 is applied to the surface of the image carrier 1 from the protective-agent supplying unit 22, and a film-like protective layer is formed thereon by the protective-layer forming mechanism 24. The protective agent 21 has more excellent adsorption capability. Therefore, if this protective agent is applied to a portion of the surface of the image carrier 1 which becomes highly hydrophilic due to electrical stress, large electrical stress is temporarily applied to the portion. However, even if the surface of the image carrier thereby starts degradation, the adsorption of the protective agent allows prevention of the progress of degradation in the image carrier 1 itself.

An electrostatic latent image is formed on the image carrier 1 with the protective layer formed thereon, through exposure using laser L after the image carrier 1 is charged, the latent image is developed by a developing device 5 into a visible image, and the visible image is transferred onto an intermediate transfer medium 7 by a transfer device 6 as a transfer roller provided outside the process cartridge.

The protective agent 21 is rod shaped (bar) in this case, and is scraped by the brush-shaped protective-agent supplying unit 22 to be supplied to the photosensitive element. However, the protective agent may be previously powdered to be supplied to the photosensitive element.

Figure 3:
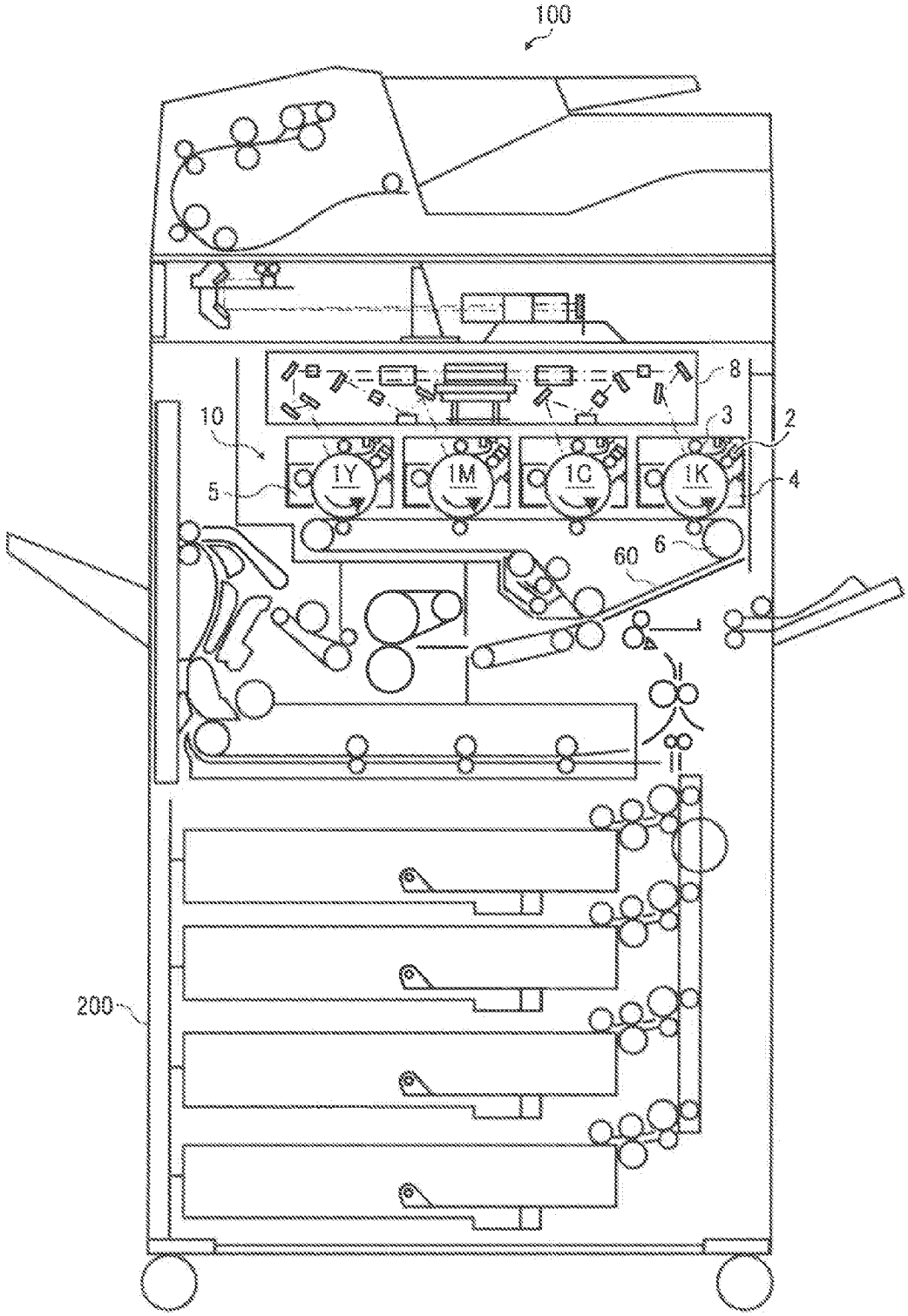
FIG. 3 is a schematic diagram of an image forming apparatus including the protective-agent applying device.

FIG. 3 is a schematic diagram of an image forming apparatus 100 including the protective-agent applying device 2.

Arranged around the image carrier 1 (1Y, 1M, 1C, 1K) are the protective-agent applying device 2, a charger 3, a latent-image forming device 8, the developing device 5, the transfer device 6, and a cleaning device 4. An image is formed in the following manner.

A series of processes for image formation are explained below using a negative-positive process.

The image carrier 1 represented by an organic photosensitive element (OPC) having an organic photoconductive layer is decharged by a decharging lamp (not shown), and uniformly charged to negative by the charger 3 having a charging unit.

When the image carrier 1 is charged by the charger 3, a certain amount of voltage appropriate for charging of the image carrier 1 to a desired potential or a charging voltage obtained by superimposing AC voltage on the voltage is applied from a voltage applying mechanism (not shown) to the charging unit.

The charged image carrier 1 is irradiated with a laser beam emitted by the latent-image forming device 8 such as a laser optical system to form a latent image thereon (the absolute value of the potential at an exposed portion is lower than the absolute value of the potential at a non-exposed portion). The laser beam is emitted from a semiconductor laser, and scans the surface of the image carrier 1 in the direction of the rotating axis of the image carrier 1 by a polygon mirror that rotates at high speed.

The latent image formed in the above manner is developed by a developer formed of toner particles supplied to a developing sleeve which is a developer carrier provided in the developing device 5 or formed of a mixture of toner particles and carrier particles, to form a visible image or a toner image. When the latent image is to be developed, an appropriate amount of voltage or a developing bias obtained by superimposing AC voltage on the voltage is applied from the voltage applying mechanism (not shown) to the developing sleeve.

A toner image formed on the image carrier 1 corresponding to each of colors is transferred onto the intermediate transfer medium 7 by the transfer device 6, and the toner image is transferred onto a transfer medium such as a paper sheet fed from a feed mechanism 200. At this time, as a transfer bias, a potential having a polarity opposite to that of charged toner is preferably applied to the transfer device 6. Thereafter, the intermediate transfer medium 7 is separated from the image carrier 1, to obtain a transferred image.

The toner particles remaining on the image carrier 1 are collected by the cleaning unit 41 into a toner collecting chamber in the cleaning device 4.

The image forming apparatus may be configured to arrange a plurality of developing devices, sequentially form a plurality of toner images of different colors by the developing devices, sequentially transfer the formed toner images to a transfer material, and send the transferred toner image to a fixing mechanism, where the toner image is thermally fixed on the transfer material. The image forming apparatus may also be configured to form a plurality of toner images formed in the same manner as above, temporarily transfer the toner images sequentially to an intermediate transfer medium, collectively transfer the transferred toner images to a transfer medium such as a paper sheet, and then fix the toner image thereon in the above manner.

The charger 3 is preferably arranged in contact with or close to the surface of the image carrier. With this feature, the amount of ozone produced upon charging can largely be suppressed as compared with a corona discharger called corotron or scorotron using an electrical-discharge wire.

However, in the charger that charges the image carrier 1 with the charging unit when it is in contact with or close to the surface of the image carrier 1, electrical discharge is performed in an area close to the surface thereof as explained above, and thus electrical stress to the image carrier tends to increase. By using the protective-agent applying device 2 that uses the protective agent 21, the image carrier can be maintained over the long period of time without degradation. Thus, it is possible to largely suppress variation of images over time or variation of images due to the use environment and ensure stable image quality.

Preferably, the photosensitive element of the image forming apparatus has a photoconductive layer provided on a conductive support. The photoconductive layer is of a single layer type in which a charge generation material and a charge transport material are provided, a normal laminated type in which a charge transport layer is provided on a charge generation layer, or a reverse laminated type in which a charge generation layer is provided on a charge transport layer. A protective layer can also be provided on the photoconductive layer to improve mechanical strength, wear resistance, gas resistance, and cleaning performance of the photosensitive element. An undercoat layer can also be provided between the photoconductive layer and the conductive support. A plasticizer, an antioxidant, and a leveling agent can also be added by an appropriate amount to each layer if necessary.

As the conductive support of the photosensitive element, a conductive unit having a volume resistivity of $10^{10}$ Ω·cm or less can be used. The conductive unit includes one obtained by coating metal or a metal oxide on a film-like or cylindrical plastic or a sheet of paper by evaporation or spattering. More specifically, the metal includes aluminum, nickel, chrome, Nichrome, copper, gold, silver, and platinum; and the metal oxide includes tin oxide and indium oxide. The conductive unit also includes a plate of aluminum, aluminum alloy, nickel, or stainless steel; and a tube obtained by forming a drum-shape unit tube with any one of the plates using an extrusion or an extraction method, and subjecting the element tube to surface treatment such as cutting, finishing, and polishing. Any drum-shape support as follows can be used: a diameter thereof is 20 millimeters to 150 millimeters, preferably 24 millimeters to 100 millimeters, and more preferably 28 millimeters to 70 millimeters. If the diameter thereof is 20 millimeters or less, it is not preferred because it is physically difficult to arrange processes such as charging, exposure, development, transfer, and cleaning around the drum. If the diameter is 150 millimeters or more, it is also not preferred because the size of the image forming apparatus increases. Particularly, a tandem type image forming apparatus needs to have a plurality of photosensitive elements, and for this reason, the diameter of each photosensitive element is 70 millimeters or less, preferably 60 millimeters or less. An endless nickel belt or an endless stainless belt disclosed in Japanese Patent Application Laid-Open No. S52-36016 can also be used as the conductive support.

The undercoat layer of the photosensitive element used in the image forming apparatus can be resin, or a material containing white pigment and resin as a main component, and a metal oxide film obtained by chemically or electro-chemically oxidizing the surface of a conductive base. The material containing white pigment and resin as a main component is preferable. Examples of the white pigment include metal oxides such as titanium oxide, aluminum oxide, zirconium oxide, and zinc oxide, and it is most preferable to contain the zinc oxide which is excellent in capability of preventing charge injection from a conductive substrate. Examples of resin used for the undercoat layer include thermoplastic resin such as polyamide, polyvinyl alcohol, casein, and methylcellulose; thermosetting resin such as acryl, phenol, melamine, alkyd, unsaturated polyester, and epoxy, and these can be used singly or as a mixture of two or more.

Examples of the charge generation material of the photosensitive element used in the image forming apparatus include azo pigment such as monoazo pigment, bisazo pigment, trisazo pigment, and tetrakisazo pigment; organic pigments or dyes such as triallylmethane dyes, thiazine dyes, oxazine dyes, xanthene dyes, cyanine dyes, styryl pigment, pyrylium dyes, quinacridone pigment, indigo pigment, perylene pigment, polycyclic quinone pigment, bisbenzimidazol pigment, indanthrene pigment, squarylium pigment, and phthalocyanine pigment; inorganic materials such as selenium, selenium-arsonic, selenium-tellurium, cadmium sulfide, zinc oxide, titanium oxide, and amorphous silicon, and these can be used singly or in combination of two or more.

The undercoat layer may be one layer or a plurality of layers.

Examples of the charge transport material of the photosensitive element used in the image forming apparatus include anthracene derivatives, pyrene derivatives, carbazole derivatives, tetrazole derivatives, metallocene derivatives, phenothiazine derivatives, pyrazoline compounds, hydrazone compounds, styryl compounds, styryl hydrazone compounds, enamine compounds, butadiene compounds, distyryl compounds, oxazole compounds, oxadiazole compounds, thiazole compounds, imidazole compounds, triphenylamine derivatives, phenylene diamine derivatives, aminostilbene derivatives, and triphenylmethane derivatives, and these can be used singly or in combination of two or more.

A binder resin for use in formation of the photoconductive layer having the charge generation layer and the charge transport layer has electrical insulation property, and known resins with this property such as thermoplastic resin, thermosetting resin, light-curing resin, and photoconductive resin can be used. Examples of an appropriate binder resin include thermoplastic resin such as polyvinyl chloride, polyvinylidene chloride, vinyl chloride-vinyl acetate copolymer, vinyl chloride-vinyl acetate-maleic anhydride copolymer, ethylene-vinyl acetate copolymer, polyvinyl butyral, polyvinyl acetal, polyester, phenoxy resin, (metha) acrylic resin, polystyrene, polycarbonate, polyarylate, polysulphone, polyethersulphone, and ABC resin; thermosetting resin such as phenyl resin, epoxy resin, urethane resin, melamine resin, isocyanate resin, alkyd resin, silicone resin, thermosetting acrylic resin; and photoconductive resin such as polyvinyl carbazole, polyvinyl anthracene, and polyvinyl pyrene, and these can be used singly or as a mixture of two or more binder resins but the binder resin is not limited thereto.

As the antioxidant, those as follows are used. Monophenol Compounds 2,6-di-t-butyl-p-cresol, butylated hydroxyanisole, 2,6-di-t-butyl-4-ethyl phenol, stearyl-β-(3,5-di-t-butyl-4-hydroxyphenyl)propionate, and 3-t-butyl-4-hydroxynisole, and the like.

Bisphenol Compounds 2,2'-methylene-bis(4-methyl-6-t-butylphenol), 2,2'-methylene-bis(4-ethyl-6-t-butylphenol), 4,4'-thiobis(3-methyl-6-t-butylphenol), and 4,4'-butylidenebis(3-methyl-6-t-butylphenol), and the like.

High Molecular Phenol Compounds 1,1,3-tris-(2-methyl-4-hydroxy-5-t-butylphenyl)butane, 1,3,5-trimethyl-2,4,6-tris(3,5-di-t-butyl-4-hydroxybenzyl) benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, tocophenol, and the like.

Paraphenylenediamine Group

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, and the like.

Hydroquinone Group 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone, and the like.

Organic Sulfur Compounds

Dilauryl-3,3'-thiodipropionate, distearyl-3,3'-thiodipropionate, ditetradecyl-3,3'-thiodipropionate, and the like.

Organic Phosphorus Compounds

Triphenylphosphine, tri(nonylphenyl)phosphine, tri(dinonylphenyl)phosphine, tricresylphosphine, tri(2,4-dibutylphenoxy)phosphine, and the like.

As the plasticizer, an ordinary resin plasticizer such as dibutyl phthalate and dioctyl phthalate can be used as it is. The content of the plasticizer is preferably from about 0 to 30 parts by weight (wt. parts) per 100 wt. parts of the binder resin.

The leveling agent is allowed to be added to the charge transport layer. Examples of the leveling agent include silicone oils such as dimethyl silicone oils and methylphenyl silicone oils; and polymers or oligomers having a perfluoroalkyl group in their side chain. The content of the leveling agent in the charge transport layer is preferably from 0 to 1 wt. part per 100 wt. parts of the binder resin.

As explained above, the surface layer is provided to improve mechanical strength, wear resistance, gas resistance, and cleaning performance of the photosensitive element. An example of the surface layer includes a layer made of polymer with higher mechanical strength than that of the photoconductive layer, and a layer obtained by dispersing inorganic filler in the polymer. The polymer used for the surface layer may be either one of thermoplastic polymer and thermosetting polymer. However, the thermosetting polymer is more preferable because of its high mechanical strength and extremely high capability to suppress wear due to friction with the cleaning blade. If the surface layer is thin, no trouble occurs even if it does not have charge transport capability. However, if the surface layer without charge transport capability is formed thick, then the thick surface layer easily causes reduction in sensitivity of the photosensitive element, an increase in potential after exposure, and also an increase in residual potential. Therefore, it is preferred to cause the charge transport material to be contained in the surface layer or to use a material having the charge transport capability as polymer used for the protective layer. Generally, the mechanical strength of the photoconductive layer is largely different from that of the surface layer. Consequently, if the protective layer is worn and removed due to friction with the cleaning blade, then the photoconductive layer starts wearing at once. Therefore, if the surface layer is provided, the surface layer is important to have an adequate thickness. The thickness is from 0.01 micrometer to 12 micrometers, preferably 1 micrometer to 10 micrometers, and more preferably 2 micrometers to 8 micrometers. If the thickness of the surface layer is 0.1 micrometer or less, it is not preferred because the surface layer is too thin, part of the surface layer is easily removed due to friction with the cleaning blade, and the wear of the photosensitive element progresses from the removed portion. If the thickness of the surface layer is 12 micrometer or more, then the thick surface layer easily causes reduction in sensitivity of the photosensitive element, an increase in potential after exposure, and also an increase in residual potential. Particularly, if the polymer having the charge transport capability is used, it is also not preferred because the cost of the polymer having the charge transport capability is increased.

Desirable polymer used for the surface layer is transparent with respect to a write beam upon image formation, and excellent in insulation, mechanical strength, and adhesiveness. Examples of the polymer are ABS resin, ACS resin, olefin-vinyl monomer copolymer, chlorinated polyether, aryl resin, phenol resin, polyacetal, polyamide, polyamide-imide, polyacrylate, polyarylsulphone, polybutylene, polybutylene terephthalate, polycarbonate, polyethersulphone, polyethylene, polyethylene terephthalate, polyimide, acrylic resin, polymethylpentene, polypropylene, polyphenylenoxide, polysulphone, polystyrene, AS resin, butadiene-styrene copolymer, polyurethane, polyvinyl chloride, polyvinylidene chloride, and epoxy resin. These polymers may be thermoplastic polymers, but to enhance the mechanical strength of the polymer, the cross-link is made using a cross-linking agent having polyfunctional acryloyl group, carboxyl group, hydroxyl group, amino group, and the like, to obtain thermosetting polymer. The obtained thermosetting polymer allows increase in mechanical strength of the surface layer and large reduction in wear due to friction with the cleaning blade.

As explained above, it is preferable that the surface layer has the charge transport capability. And, to provide the charge transport capability to the surface layer, there are two methods, a method of using a mixture of the polymer used for the surface layer and the charge transport material and a method of using the polymer having the charge transport capability for the surface layer. The latter one is preferred because the photosensitive element highly sensitive and with less increase of potential after exposure and less increase of residual potential can be obtained.

An example of the polymer having the charge transport capability can be a group having the charge transport capability in the polymer expressed by Formula (2) as follows:

[Formula 2] (2)

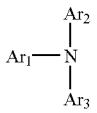

where $Ar_1$ represents substituted or unsubstituted arylene group, and $Ar_2$ and $Ar_3$ represent individually substituted or unsubstituted aryl groups (both of them can be the same as or different from each other).

The group having the charge transport capability is preferably added to the side chain of a polymer with the high mechanical strength such as polycarbonate resin and acrylic resin, and the acrylic resin is preferably used because it is easy to manufacture monomer and is excellent in coating capability and setting capability.

By polymerizing acrylic resin having the charge transport capability with unsaturated carboxylic acid having the groups in Formula (2), it is possible to form the surface layer having high mechanical strength and charge transport capability, and being excellent in transparency. By mixing the unsaturated carboxylic acid having the monofunctional groups in Formula (2) with polyfunctional unsaturated carboxylic acid, preferably 3 or more functional unsaturated carboxylic acid, the acrylic resin forms a cross-linked structure, which becomes thermosetting polymer. With these processes, the mechanical strength of the surface layer becomes extremely high. The groups in Formula (2) may be added to the polyfunctional unsaturated carboxylic acid. However, manufacturing cost of monomer increases, and thus, it is preferred not to add the groups in Formula (2) to the polyfunctional unsaturated carboxylic acid, but to use ordinary light-curable polyfunctional monomer instead.

Examples of monofunctional unsaturated carboxylic acid having the groups in Formula (2) are as shown in Formula (3) and Formula (4) as follows:

[Formula 3] (3)

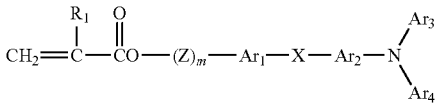

[Formula 4] (4)

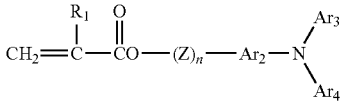

where $R_1$ represents a hydrogen atom, a halogen atom, an alkyl group which may have a substituted group, an aralkyl group which may have a substituted group, an aryl group which may have a substituted group; a cyano group, a nitro group; an alkoxy group, —$COOR_7$ ($R_7$ represents a hydrogen atom, an alkyl group which may have a substituted group, an aralkyl group which may have a substituted group, or an aryl group which may have a substituted group), a carbonyl halide group, or $CONR_8R_9$ ($R_8$ and $R_9$ represent a hydrogen atom, a halogen atom, an alkyl group which may have a substituted group, an aralkyl group which may have a substituted group, or an aryl group which may have a substituted group and both of them can be the same as or different from each other); $Ar_1$ and $Ar_2$ represent individually substituted or unsubstituted arylene groups (both of them can be the same as or different from each other); $Ar_3$ and $Ar_4$ represent individually substituted or unsubstituted aryl groups (both of them can be the same as or different from each other); X represents a single bond, a substituted or unsubstituted alkylene group, a substituted or unsubstituted cycloalkylene group, a substituted or unsubstituted alkylene ether group, an oxygen atom, a sulfur atom, and a vinylene group; Z represents a substituted or unsubstituted alkylene group, a substituted or unsubstituted alkylene ether divalent group, and an alkylene oxycarbonyl divalent group; and m and n represent an integer 0 to 3.

The proportion of the polyfunctional unsaturated carboxylic acid is 5 wt % to 75 wt % of the entire surface layer, preferably 10 wt % to 70 wt %, more preferably 20 wt % to 60 wt %. If the proportion of the polyfunctional unsaturated carboxylic acid is 5 wt % or less, it is not preferred because the mechanical strength of the surface layer is insufficient. If it is 75 wt % or more, it is also not preferred because the surface layer may easily be cracked when the strong force is applied thereto and sensitivity may easily be degraded.

When the acrylic resin is used for the surface layer, the surface layer can be formed by coating the unsaturated carboxylic acid to the photosensitive element, and irradiating electron beams or active rays such as ultraviolet rays thereto to cause radical polymerization. When the radical polymerization is conducted by the active rays, a solution in which a photopolymerization initiator is dissolved in the unsaturated carboxylic acid. As the photopolymerization initiator, a material used for light-curable paint can be usually used.

To enhance the mechanical strength of the surface layer, fine particles of metal or metal oxide can be dispersed in the surface layer. Examples of metal oxide are titanium oxide, tin oxide, potassium titanate, TiO, TiN, zinc oxide, indium oxide, and antimony oxide. In addition to these materials, fluororesin such as polytetrafluoroethylene, silicone resin, and a material obtained by dispersing inorganic matter to any of these resins can be added to improve the wear resistance.

The protective agent may be previously applied to the photosensitive element. It is preferred that by previously applying the protective agent thereto, nonuniform application of the protective agent at the initial stage of image formation can be resolved and high-quality images without defective images can be formed.

The protective-agent applying device 2 prevents the protective agent from being non-uniformly formed over the photosensitive element even if the protective agent is continuously applied to the photosensitive element. Therefore, no problem arises even if the protective agent is previously deposited on the photosensitive element.

The image carrier 1 may be an intermediate transfer medium used for image formation using an intermediate transfer system in which each toner image formed on a photosensitive element is primarily transferred and superimposed on one after another, and the toner images are further transferred onto a transfer medium. The intermediate transfer medium is preferably an element having conductive properties of volume resistivity of $10^5$ to $10^{11}$ Ω·cm. If the surface resistivity is below $10^5$ Ω/cm, an electrical discharge may be produced upon transfer of a toner image from the photosensitive element to the intermediate transfer medium and "transfer dust" may occur upon the transfer, and thus the toner image blurs due to the transfer dust. If it is above $10^{11}$ Ω/cm, after the toner image is transferred from the intermediate transfer medium to a transfer medium such as a paper sheet, the opposite charge to that of the toner image remains on the intermediate transfer medium, and may appear on the next image as an afterimage.

A belt-shaped or cylindrical plastic can be used as the intermediate transfer medium. The plastic is obtained by kneading singly or in combination of conductive particles, such as metal oxide including tin oxide and indium oxide and carbon black, or of conductive polymer with thermoplastic resin, and subjecting the kneaded materials to extrusion molding. In addition to this, an intermediate transfer medium on an endless belt can also be obtained by adding the conductive particles or the conductive polymer to a resin solution containing monomers and oligomers having thermal crosslinking reactivity if necessary, and subjecting the mixed resin solution to centrifugal molding while being heated.

When the surface layer is to be provided on the intermediate transfer medium, a conductive substance is used in combination of any required composition, other than the charge transport material, of the materials used for the surface layer of the photosensitive element, and the resistivity thereof is controlled. Thus, the obtained conductive substance can be used for the surface layer.

Toner preferably used is explained below.

According to the first embodiment, toner preferably has an average circularity of 0.93 to 1.00. A value obtained by the following equation is defined as circularity. The circularity is an index of the degree of irregularities of toner particles, and if the value is 1.00, then the shape of toner is perfect sphericity, and if the surface profile is more irregular, the circularity is getting a smaller value.

Circularity SR=Circumferential length of a circle having an area equivalent to a projected area of a particle/Circumferential length of a projected image of the particle If the average circularity is in a range of 0.93 to 1.00, then respective surfaces of the toner particles are smooth, and each contact area between a toner particle and the photosensitive element is small, which allows excellent transfer performance. Toner particles have no angular portions, mixing torque of the developer in the developing device is small and mixing is stably driven, which does not cause defective images. Because there are no angular toner particles in the toner particles to form dots, when the toner particles are press-contacted with the transfer medium upon transfer, the pressure is evenly applied to all the toner particles forming dots, and voids due to improper transfer thereby hardly occur. Because the toner particles are not angular-shaped, grinding force thereof is small, and thus, the toner particles do not damage the surface of the image carrier nor wear the surface thereof.

The method of measuring the circularity is explained below.

The circularity can be measured by using Particle Analyzer FPIA-1000 manufactured by Toa Medical Electronics.

A specific method of measuring the circularity is as follows. That is, water of 100 milliliters to 150 milliliters from which impurity solid is previously removed is put into a container, a surfactant being a dispersing agent, preferably 0.1 milliliter to 0.5 milliliter of alkylbenzene sulfonic acid, is added to the water, and sample to be measured is further added thereto by about 0.1 gram to 0.5 gram. A suspension with the sample dispersed therein is dispersed for about 1 minute to 3 minutes by an ultrasonic disperser, and concentration of a dispersing solution is controlled to 3,000 to 10,000 pieces/μl, and each shape and particle size of toner particles are thereby measured.

A weight-average particle size D4 of toner is preferably 3 micrometers to 10 micrometers.

In this range, the particle size of toner particles is sufficiently small with respect to fine dots of the latent image, and thus the toner particles are excellent in dot reproducibility. If the weight-average particle size D4 is below 3 micrometers, then phenomena such as decrease in transfer efficiency and degradation of blade cleaning performance are easily occur. If the weight-average particle size D4 exceeds 10 micrometers, then it is difficult to suppress "toner flying" of toner supposed to form a character and a line.

As for the toner, a ratio (D4/D1) between the volume-average particle size D4 and a number-average particle size D1 is preferably 1.00 to 1.40. If the value of (D4/D1) is closer to 1, a particle size distribution of toner particles is sharper.

Therefore, if (D4/D1) is in a range of 1.00 to 1.40, then selective development due to the toner particle size does not occur, and thus the toner is excellent in stability of image quality. Because the particle-size distribution of the toner is sharp, a distribution of triboelectrically-charged amounts is also sharp, and occurrence of fogging can thereby be suppressed. If toner particle sizes are uniform, the toner particles are developed onto dots of the latent image to be arrayed in a finely and orderly manner, thus being excellent in dot reproducibility.

A method of measuring a particle-size distribution of toner particles is explained below.

Examples of a measurement device of a particle-size distribution of toner particles based on Coulter Counter method are Coulter Counter TA-II and Coulter Counter Multisizer II (both manufactured by Coulter Co.). The measurement method is explained below.

A surfactant (preferably alkylbenzene sulfonic acid) being a dispersing agent is added by 0.1 milliliter to 5 milliliters into 100 milliliters to 150 milliliters of electrolytic water. The electrolytic solution is obtained by preparing about 1% NaCl aqueous solution by using primary sodium chloride, and for example, ISOTON-II (manufactured by Coulter Co.) can be used to prepare it. Sample to be measured is further added thereto by 2 milligrams to 20 milligrams. An electrolytic solution with the sample suspended therein is dispersed for about 1 minute to 3 minutes by an ultrasonic disperser. And the measurement device is used to measure the volume and the number of toner particles or toner using 100 μm-aperture and calculate a volume distribution and a number distribution. From the obtained distributions, the weight-average particle size D4 of toner and the number-average particle size D1 can be determined.

As a channel, 13 channels as follows are used and particles having a particle size not less than 2.00 micrometers to less than 40.30 micrometers are targeted: 2.00 to less than 2.52, 2.52 to less than 3.17, 3.17 to less than 4.00, 4.00 to less than 5.04, 5.04 to less than 6.35, 6.35 to less than 8.00, 8.00 to less than 10.08, 10.08 to less than 12.70, 12.70 to less than 16.00, 16.00 to less than 20.20, 20.20 to less than 25.40, 25.40 to less than 32.00, and 32.00 to less than 40.30 (unit: micrometer).

The substantially spherical-shaped toner is preferably toner formed by crosslinking reaction and/or elongation reaction of a toner composition in an aqueous medium in the presence of resin fine particles. Specifically, the toner composition contains a polyester prepolymer having a functional group that contains nitrogen atoms, a polyester, a colorant, and a release agent. The toner manufactured using the reaction hardens the toner surface, which allows reduction in toner hot offset, and thus, it can be suppressed that the fixing device is contaminated with the toner which results in dirt appearing on an image.

An example of prepolymer formed of modified polyester resin which can be used for manufacture of toner includes an isocyanate group-containing polyester prepolymer (A), and an example of compounds that elongate or cross-link with the prepolymer includes an amine group (B).

Examples of the isocyanate group-containing polyester prepolymer (A) include reaction products of a polyester with a polyisocyanate compound (3), and the like. More specifically, the polyester is a polycondensation product between a polyol (1) and a polycarboxylic acid (2), and has an active hydrogen group. Examples of the active hydrogen group of the polyester are hydroxyl groups such as an alcoholic hydroxyl group and a phenolic hydroxyl group, an amino group, a carboxyl group, a mercapto group, and the like. Among them, the alcoholic hydroxyl group is preferred.

Examples of polyol (1) include diol (1-1) and trivalent or more polyhydric alcohols (1-2); and (1-1) alone or a mixture of (1-1) with a small amount of (1-2) is preferable. Examples of diol (1-1) include alkylene glycol (e.g. ethylene glycol, 1,2-propylene glycol, 1,3-propylene glycol, 1,4-butanediol, and 1,6-hexanediol); alkylene ether glycols (e.g. diethylene glycol, triethylene glycol, dipropylene glycol, polyethylene glycol, polypropylene glycol, and polytetramethylene ether glycol); alicyclic diols (e.g. 1,4-cyclohexane dimethanol, and hydrogenated bisphenol A); bisphenols (e.g. bisphenol A, bisphenol F, and bisphenol S); adducts of alkylene oxide of the alicyclic diols (e.g. ethylene oxide, propylene oxide, and butylene oxide); and adducts of alkylene oxide of the bisphenols (e.g. ethylene oxide, propylene oxide, and butylene oxide). Among these, alkylene glycol having a carbon number from 2 to 12 and the adducts of alkylene oxides of the bisphenols are preferable. Particularly preferable are the adducts of alkylene oxides of the bisphenols, and a combination of the adducts of alkylene oxides of the bisphenols and alkylene glycol having a carbon number from 2 to 12. Trivalent or more polyhydric alcohols (1-2) include trihydric to octahydric alcohols and more aliphatic alcohols (e.g. glycerol, trimethylolethane, trimethylolpropane, pentaerythritol, and sorbitol); trivalent or more phenols (e.g. trisphenol PA, phenol novolak, and cresol novolak); and adducts of alkylene oxides of the trivalent or more polyphenols.

Examples of the polycarboxylic acid (2) include a dicarboxylic acid (2-1) and a trivalent or more polycarboxylic acid (2-2); and (2-1) alone and a mixture of (2-1) and a small amount of (2-2) are preferable. Examples of dicarboxylic acids (2-1) include alkylene dicarboxylic acids (e.g. succinic acid, adipic acid, and sebacic acid); alkenylene dicarboxylic acids (e.g. maleic acid and fumaric acid); and aromatic dicarboxylic acids (e.g. phthalic acid, isophthalic acid, terephthalic acid, and naphthalene dicarboxylic acid). Among these, the alkenylene dicarboxylic acids having a carbon number from 4 to 20 and the aromatic dicarboxylic acids having a carbon number from 8 to 20 are preferred. Examples of trivalent or more carboxylic acids (2-2) include aromatic polycarboxylic acids having a carbon number from 9 to 20 (e.g. trimellitic acid and pyromellitic acid). The polycarboxylic acid (2) may be reacted with polyol (1) using acid anhydrides of these or lower alkyl esters (e.g. methyl ester, ethyl ester, and isopropyl ester).

A ratio between the polyol (1) and the polycarboxylic acid (2) is usually from 2/1 to 1/1, preferably from 1.5/1 to 1/1, more preferably from 1.3/1 to 1.02/1, as an equivalent ratio of [OH]/[COOH] between a hydroxyl group [OH] and a carboxyl group [COOH].

Examples of polyisocyanate (3) are aliphatic polyisocyanates (e.g. tetramethylene diisocyanate, hexamethylene diisocyanate, and 2,6-diisocyanate methyl caproate); alicyclic polyisocyanates (e.g. isophorone diisocyanate and cyclohexylmethane diisocyanate); aromatic diisocyanates (e.g. tolylene diisocyanate and diphenylmethane diisocyanate); aromatic aliphatic diisocyanates (e.g. α,α,α',α'-tetramethylxylylene diisocyanate); isocyanates; compounds formed by blocking these polyisocyanates by a phenol derivative, an oxime, and a caprolactam; and a combination of at least two of these.

A ratio of the polyisocyanate (3) is usually from 5/1 to 1/1, preferably from 4/1 to 1.2/1, and more preferably from 2.5/1 to 1.5/1, as an equivalent ratio of [NCO]/[OH] between an isocyanate group [NCO] and a hydroxyl group [OH] of a hydroxyl group-containing polyester. When [NCO]/[OH] exceeds 5, the low-temperature fixing property gets worse. In a case of using urea-modified polyester, the urea content in the ester becomes low when a molar ratio of [NCO] is less than 1, and hot offset resistance deteriorates. The content of the polyisocyanate (3) in the isocyanate group-containing polyester prepolymer (A) ranges usually from 0.5 wt % to 40 wt %, preferably from 1 wt % to 30 wt %, and more preferably from 2 wt % to 20 wt %. If the content of the polyisocyanate compound is less than 0.5 wt %, the hot offset resistance deteriorates, and it is unfavorable from the viewpoint of compatibility of heat resistant preservability and low-temperature fixing property. On the other hand, if the content of the polyisocyanate compound exceeds 40 wt %, the low-temperature fixing property gets worse.

The number of isocyanate groups contained in one molecule of the isocyanate group-containing polyester prepolymer (A) is usually at least 1, preferably, an average of 1.5 to 3, and more preferably, an average of 1.8 to 2.5. If the isocyanate group per molecule is less than 1, then the molecular weight of the urea-modified polyester becomes low and the hot offset resistance deteriorates.

Amines (B) include diamine (B1), trivalent or more polyamine (B2), amino alcohols (B3), amino mercaptans (B4), amino acids (B5), and the compounds (B6) of B1 to B5 in which their amino groups are blocked. Examples of the diamine (B1) include aromatic diamines (e.g. phenylene diamine, diethyl toluene diamine, and 4,4'-diaminodiphenyl methane); alicyclic diamines (e.g. 4,4'-diamino-3,3'-dimethyldicyclohexylmethane, diamine cyclohexane, and isophorone diamine); and aliphatic diamines (e.g. ethylene diamine, tetramethylene diamine, and hexamethylene diamine). Examples of the trivalent or more amine compounds (B2) include diethylene triamine and triethylene tetramine. Examples of the amino alcohols (B3) include ethanolamine and hydroxyethylaniline. Examples of the amino mercaptans (B4) include aminoethyl mercaptan and aminopropyl mercaptan. Examples of the amino acids (B5) include aminopropionic acid and aminocaproic acid. Examples of the compounds (B6), in which the amino groups of B1 to B5 are blocked, include ketimine compounds obtained from the amines of B1 to B5 and ketones (e.g. acetone, methyl ethyl ketone, and methyl isobutyl ketone), and oxazolidine compounds. The preferable amines among the amines (B) are B1 and a mixture of B1 with a small amount of B2.

A reaction inhibitor is used as required for crosslinking reaction between a polyester prepolymer (A) and amines (B) to obtain the modified polyester (i) and/or elongation reaction, thereby adjusting the molecular weight of the urea-modified polyester obtained. Examples of the reaction inhibitor include monoamines (e.g., diethylamine, dibutylamine, butylamine, and laurylamine), and compounds (ketimine compounds) in which the monoamines are blocked.

A ratio of amines (B) is usually 1/2 to 2/1, preferably 1.5/1 to 1/1.5, and more preferably 1.2/1 to 1/1.2 as an equivalent ratio of [NCO]/[NHx] between an isocyanate group [NCO] in the isocyanate group-containing polyester prepolymer (A) and an amine group [NHx] in the amines (B). When [NCO]/[NHx] exceeds 2 or is less than 1/2, the molecular weight of the urea-modified polyester (i) becomes smaller, resulting in deterioration in hot offset resistance. An urethane bond may be contained together with an urea bond in the polyester modified urea bond. A molar ratio of the urea bond content and the urethane bond content ranges usually from 100/0 to 10/90, preferably from 80/20 to 20/80, and more preferably from 60/40 to 30/70. If the molar ratio of the urea bond is less than 10%, the hot offset resistance deteriorates.

The urea-modified polyester (i) used for the toner can be made by these reactions. The urea-modified polyester (i) is manufactured by a one shot method and a prepolymer method. The weight-average molecular weight of the urea-modified polyester (i) is usually not less than 10,000, preferably 20,000 to 10,000,000, and more preferably 30,000 to 1,000,000. If the weight-average molecular weight is less than 10,000, the hot offset resistance deteriorates. A number-average molecular weight of the urea-modified polyester (i) is not particularly limited when a native polyester (ii) explained later is used, and the number-average molecular weight should be one which is easily obtained to get a weight-average molecular weight. When the urea-modified polyester (i) is used alone, the number-average molecular weight is usually 20,000 or less, preferably 1,000 to 10,000, and more preferably 2,000 to 8,000. When the number-average molecular weight exceeds 20,000, the low-temperature fixing property deteriorates and the glossiness also deteriorates when used for full-color apparatus.

In the toner, the urea-modified polyester (i) can be used alone, and also a native polyester (ii) can be contained together with (i) as a binder resin component. By using (i) in combination with the native polyester (ii), the low-temperature fixing property is improved and the glossiness is also improved when used for full-color apparatus, which is more preferable than a single use of (i). Examples of the native polyester (ii) include polycondensation of polyol (1) and polycarboxylic acid (2), similarly to the polyester component of (i), and preferred compounds are also the same as (i). The native polyester (ii) may be not only a native polyester but also modified one through a chemical bond other than an urea bond, for example, (ii) may be modified with an urethane bond. It is preferable that at least parts of (i) and (ii) are compatible with each other, from viewpoint of low-temperature fixing property and hot offset resistance. Therefore, polyester components of (i) and (ii) have preferably similar compositions. A weight ratio between (i) and (ii) when (ii) is contained is usually 5/95 to 80/20, preferably 5/95 to 30/70, more preferably 5/95 to 25/75, and particularly preferably 7/93 to 20/80. When the weight ratio of (i) to (ii) is less than 5%, the hot offset resistance deteriorates, and this becomes disadvantageous in respect of compatibility between heat resistant preservability and low-temperature fixing property.

The peak molecular weight of (ii) is usually 1,000 to 30,000, preferably 1,500 to 10,000, and more preferably 2,000 to 8,000. When it is less than 1,000, heat resistant preservability deteriorates, and when it exceeds 10,000, low-temperature fixing property deteriorates. A hydroxyl value of (ii) is preferably 5 or more, more preferably 10 to 120, and particularly preferably 20 to 80. When it is less than 5, it becomes disadvantageous in respect of compatibility between the heat resistant preservability and the low-temperature fixing property. An acid value of (ii) is preferably 1 to 30, and more preferably 5 to 20. By having the acid value tends to be easily negative electric.

In the toner, a glass transition point (Tg) of binder resin is usually from 50° C. to 70° C., and preferably from 55° C. to 65° C. If Tg is less than 50° C., blocking when toner is stored under high temperature deteriorates, while if Tg exceeds 70° C., the low temperature fixing property becomes insufficient. Under coexistence with urea-modified polyester resin, the dry toner tends to show better heat resistant preservability as compared with known polyester toner, even if the glass transition point is low. The temperature (TG') at which the storage elastic modulus of the binder resin at a measuring frequency of 20 Hz is 10000 dyne/cm$^2$ is usually 100° C. or more, preferably from 110° C. to 200° C. If it is less than 100° C., then hot offset resistance deteriorates. The temperature (Tη) at which the viscosity of the binder resin is 1000 poises at the measuring frequency of 20 Hz is usually 180° C. or less, preferably from 90° C. to 160° C. If the temperature exceeds 180° C., the low temperature fixing property deteriorates. More specifically, TG' is preferably higher than Tη in terms of compatibility between the low temperature fixing property and the hot offset resistance. In other words, a difference between TG' and Tη (TG'−Tη) is preferably 0° C. or more, more preferably 10° C. or more, and particularly preferably 20° C. or more. The upper limit of the difference is not particularly defined. Moreover, in terms of compatibility between the heat resistant preservability and the low temperature fixing property, a difference between Tη and Tg is preferably from 0° C. to 100° C., more preferably from 10° C. to 90° C., and particularly preferably from 20° C. to 80° C.

The binder resin is manufactured by the following method.

Polyol (1) and polycarboxylic acid (2) is heated to 150° C. to 280° C. in the presence of a known esterification catalyst such as tetrabutoxytitanate and dibutyltin oxide, and by distilling water generated while pressure is reduced if required, and polyester having the hydroxyl group is obtained. Polyisocyanate (3) is reacted with the polyester at a temperature of 40° C. to 140° C. to obtain isocyanate group-containing prepolymer (A). The amine group (B) is further reacted with (A) at the temperature of 0° C. to 140° C. to obtain polyester (i) modified by urea bond. When (3) is reacted or (A) and (B) are reacted, a solvent can be used if necessary.

Examples of available solvent include those inactive to isocyanate, such as an aromatic solvent (e.g. toluene, and xylene); ketone group (e.g. acetone, methyl ethyl ketone, and methyl isobutyl ketone); ester group (e.g. ethyl acetate); amide group (e.g. dimethylformamide, and dimethylacetoamide); and ether group (e.g. tetrahydrofuran). When polyester (ii) not modified by urea bond is used at the same time, the polyester (ii) is prepared using the same method as that of the polyester having hydroxyl group, and is dissolved in and mixed with the polyester (i).

The toner can be manufactured roughly in the following method, but the method is not limited thereby.

As an aqueous medium, water may be used singly or water may be used in combination with water-soluble solvent. Examples of the water-soluble solvent include alcohol (e.g. methanol, isopropanol, and ethylene glycol), dimethyl formamide, tetrahydrofuran, cellosolves (e.g. methyl cellosolve), and lower ketones (e.g. acetone, methyl ethyl ketone).

The toner particles may be formed by reacting a dispersion of isocyanate group-containing prepolymer (A) with the amine group (B) in the aqueous medium, or previously manufactured urea-modified polyester (i) may be used. An example of the method of stably forming a dispersion of the urea-modified polyester (i) and the prepolymer (A) in the aqueous medium includes a method of adding a composition of toner materials formed of the urea-modified polyester (i) and the prepolymer (A) to the aqueous medium and dispersing it by shear force. The prepolymer (A) and other toner compositions (hereinafter, "toner materials") such as a colorant, colorant master batch, a release agent, a charge control agent, and unmodified polyester resin may be mixed upon formation of the dispersion in the aqueous medium. However, it is more preferred that the toner materials are previously mixed and then the mixture is added to the aqueous medium and dispersed. The other toner materials such as the colorant, the release agent, and the charge control agent are not necessarily mixed when particles are formed in the aqueous medium, and therefore, the other toner materials may be added to the aqueous medium after particles are formed. For example, particles without a colorant are formed and then a colorant can be added thereto in a known dyeing method.

The dispersion method is not particularly limited, and it is possible to use known facilities of a low-speed shearing type, a high-speed shearing type, a friction type, a high-pressure jet type, and an ultrasonic type. Among these, the high-speed shearing type is preferred to obtain dispersed particles having a particle size ranging from 2 micrometers to 20 micrometers. When a high-speed shearing type dispersing machine is used, the number of revolutions is not particularly limited, and is usually from 1,000 to 30,000 revolutions per minute (rpm), preferably from 5,000 rpm to 20,000 rpm. The dispersion time is not particularly limited and is usually from 0.1 minute to 5 minutes in a batch system. The dispersing temperature is usually from 0° C. to 150° C. (under a pressure), preferably from 40° C. to 98° C. Higher temperature is preferred because the dispersion containing the urea-modified polyester (i) and the prepolymer (A) has low viscosity and easily disperses.

The use amount of the aqueous medium for 100 wt. parts of the toner materials containing the urea-modified polyester (i) and the prepolymer (A) is usually 50 wt. parts to 2,000 wt. parts, preferably 100 wt. parts to 1,000 wt. parts. If the amount is less than 50 wt. parts, the toner materials are poorly dispersed, and it is thereby impossible to obtain toner particles having a predetermined particle size. On the other hand, if the amount exceeds 20,000 wt. parts, this is economically inefficient. Moreover, the dispersing agent can also be used according to need. It is preferable to use the dispersing agent because the particle-size distribution becomes sharp and dispersion is stabilized.

The process of synthesizing the urea-modified polyester (i) from the prepolymer (A) may be in such a manner that the amines (B) are added before the toner materials are dispersed in the aqueous medium to cause reaction, or may be in such a manner that the amines (B) are added after the toner materials are dispersed in the aqueous medium to cause reaction from particle interface. In this case, urea-modified polyester is preferentially generated on the surface of manufactured toner, and thus, it is also possible to provide concentration gradient inside a particle.

Examples of the dispersing agent used to be emulsified and dispersed an oil phase dispersed the toner materials to liquid including water, include anionic surfactants such as alkyl benzene sulfonate, α-olefin sulfonate, and ester phosphate; amine salts such as alkyl amine salts, aminoalcohol fatty acid derivatives, polyamine fatty acid derivatives, and imidazoline; cationic surfactants of quaternary ammonium salt types such as alkyl trimethyl ammonium salts, dialkyl dimethyl ammonium salts, alkyl dimethyl benzyl ammonium salts, pyridinium salts, alkyl isoquinolinium salts, and benzethonium chloride; nonionic surfactants such as fatty acid amide derivatives and polyhydric alcohol derivatives; and zwitterionic surfactants such as alanine, dodecyl di(aminoethyl) glycine, di(octylaminoethyl) glycine, N-alkyl-N, and N-dimethyl ammonium betaine.

Furthermore, a surfactant having a fluoroalkyl group is used to achieve a desired effect with a very small amount thereof. Preferable examples of anionic surfactants having a fluoroalkyl group are fluoroalkyl carboxylic acids having a carbon number from 2 to 10 and their metal salts; disodium perfluorooctane sulfonyl glutamate, sodium 3-[ω-fluoroalkyl (C6 to C11) oxy]-1-alkyl (C3 to C4) sulfonate, sodium 3-[ω-fluoroalkanoyl (C6 to C8)-N-ethylamino]-1-propane sulfonate, fluoroalkyl (C11 to C20) carboxylic acid and its metal salts; perfluoroalkyl carboxylic acid (C7 to C13) and its metal salts; perfluoroalkyl (C4 to C12) sulfonic acid and its metal salts, perfluorooctane sulfonic acid diethanolamide, N-propyl-N-(2-hydroxyethyl) perfluorooctane sulfonamide, perfluoroalkyl (C6 to C10) sulfonamide propyl trimethyl ammonium salts, perfluoroalkyl (C6 to C10)-N-ethylsulfonyl glycine salts, monoperfluoroalkyl (C6 to C16) ethyl phosphoric acid esters.

Examples of trade names are SURFLON S-111, S-112, and S113 (manufactured by Asahi Glass Co., Ltd.), FLUORAD FC-93, FC-95, FC-98, and FC-129 (manufactured by Sumitomo 3M Co., Ltd.), UNIDINE DS-101 and DS-102 (manufactured by Daikin Industries, Ltd.), MEGAFACE F-110, F-120, F-113, F-191, F-812, and F-833 (manufactured by Dainippon Ink & Chemicals, Inc.), EKTOP EF-102, 103, 104, 105, 112, 123A, 123B, 306A, 501, 201, and 204 (manufactured by Tochem Products Co., Ltd.), and FTERGENT F-100 and F150 (manufactured by Neos Co., Ltd.).

Examples of cationic surfactants are aliphatic primary, secondary, or tertiary amine containing a fluoroalkyl group, aliphatic quaternary ammonium salt such as ammonium salt of perfluoroalkyl (C6-C10) sulfonamide propyl trimethyl; benzalkonium salts, benzethonium chloride, pyridinium salts, and imidazolinium salts. Trade names thereof are SURFLON S-121 (manufactured by Asahi Glass Co., Ltd.), FLUORAD FC-135 (manufactured by Sumitomo 3M Co., Ltd.), UNIDYNE DS-202 (manufactured by Daikin Industries, Ltd.), MEGAFACE F-150 and F-824 (manufactured by Dainippon Ink & Chemicals, Inc.), EKTOP EF-132 (manufactured by Tochem Products Co., Ltd.), and FTERGENT F-300 (manufactured by Neos Co., Ltd.), or the like.

Moreover, poorly water-soluble inorganic dispersing agents can also be used such as calcium phosphate tribasic, calcium carbonate, titanium oxide, colloidal silica, and hydroxyapatite.

Dispersion droplets may be stabilized by a high polymer protective colloid. Examples are acids such as acrylic acid, methacrylic acid, α-cyanoacrylic acid, α-cyanomethacrylic acid, itaconic acid, crotonic acid, fumaric acid, maleic acid, or maleic anhydride; or methacrylic monomers containing a hydroxyl group such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro 2-hydroxypropyl acrylate, 3-chloro 2-hydroxypropyl methacrylate, diethylene glycol monoacrylic ester, diethylene glycol monomethacrylic ester, glycerol monoacrylic ester, glycerol monomethacrylic ester, N-methylol acrylamide, N-methylol methacrylamide; vinyl alcohol or ethers with vinyl alcohol such as vinyl methyl ether, vinyl ethyl ether, vinyl propyl ether; or esters of compounds that contains a vinyl alcohol and a carboxyl group such as vinyl acetate, vinyl propionate, vinyl butyrate; acrylamide, methacrylamide, diacetone acrylamide or their methylol compounds; acid chlorides such as chloride acrylate and chloride methacrylate; homopolymers or copolymers of nitrogen atom such as vinylpyridine, vinylpyrrolidone, vinylimidazole, and ethyleneimine or of heterocyclic ring thereof; polyoxyethylene compounds such as polyoxyethylene, polyoxypropylene, polyoxyethylene alkyl amine, polyoxypropylene alkyl amine, polyoxyethylene alkyl amide, polyoxypropylene alkyl amide, polyoxyethylene nonyl phenyl ether, polyoxyethylene lauryl phenyl ether, polyoxyethylene stearyl phenyl ester, and polyoxyethylene nonyl phenyl ester; and a cellulose group such as methyl cellulose, hydroxyethyl cellulose, and hydroxypropyl cellulose.

If a compound like calcium phosphate salt that can dissolve in an acid or an alkali is used as a dispersion stabilizer, after the calcium phosphate salt is dissolved by an acid like hydrochloric acid, the calcium phosphate salt is removed from fine particles by a method of washing. In addition, the calcium phosphate salt can be removed through decomposition by an enzyme.

When the dispersing agent is used, the dispersing agent is allowed to remain on the surface of the toner particle, but removal of the dispersing agent by washing after elongation and/or crosslinking reaction is preferred in terms of charging of toner.

Furthermore, to decrease the viscosity of the toner materials, a solvent in which urea-modified polyester (i) and prepolymer (A) are soluble can be used. It is preferred to use the solvent because the particle-size distribution becomes sharp. The solvent is preferably volatile because of easy removal. Examples of the solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone, and these can be used singly or in combination of two or more. In particular, aromatic solvent such as toluene and xylene; and halogenated hydrocarbon such as methylene chloride, 1,2-dichloroethane, chloroform, and carbon tetrachloride are preferred, and the aromatic solvent such as toluene and xylene is more preferred. The use amount of solvent is usually 0 to 300 parts for 100 parts of prepolymer (A), preferably 0 to 100 parts, and more preferably 25 to 70 parts. When the solvent is used, the solvent is heated under normal pressure or reduced pressure after elongation and/or crosslinking reaction, and is removed.

An elongation and/or crosslinking reaction time is selected according to the reactivity of a combination of an isocyanate group structure of the prepolymer (A) and amines (B), and is usually 10 minutes to 40 hours, preferably 2 hours to 24 hours. The reaction temperature is usually from 0° C. to 150° C., preferably from 40° C. to 98° C. Moreover, a known catalyst can be used according to need. Specific examples of the catalyst are dibutyltin laurate and dioctyltin laurate.

To remove an organic solvent from an obtained emulsified dispersion, it is possible to use a method of gradually heating up the whole system and perfectly evaporating and removing an organic solvent in droplets. Alternatively, it is also possible to spray the emulsified dispersion in a dry atmosphere, perfectly remove water-insoluble organic solvent in droplets to form toner particles, and also evaporate and remove an aqueous dispersing agent. As the dry atmosphere in which the emulsified dispersion is sprayed, gas, especially, various types of airflows are generally used. More specifically, the gas is obtained by heating air, nitrogen, carbon dioxide, combustion gas, or the like, and the various types of airflows are obtained by heating a solvent to be used having the maximum boiling point to the boiling point or more. Targeted quality can be sufficiently obtained by a process using a spray dryer, a belt dryer, or a rotary kiln in a short time.

When the particle-size distribution upon dispersion of emulsified dispersion is broad and washing and drying processes are performed while keeping the particle-size distribution, the broad particle-size distribution is classified into desired particle-size distributions, so that the particle-size distributions can be put in order. The classification is operated in the solution by a cyclone, decanter, or centrifugal separation, so that fine particle parts can be removed from the solution. The classification may also be operated after particles are obtained as powder after being dried, but the operation in the solution is preferred in terms of efficiency. Obtained unnecessary fine particles or coarse particles are returned again to the kneading process so that these particles can be used to form particles. In this case, fine particles or coarse particles may be wet.

It is preferable to remove the used dispersing agent from the dispersion solution as much as possible, but it is more preferable to perform the removal operation together with the classification operation.

The powder of toner obtained after being dried is mixed with heterogonous particles such as release-agent particles, charge-control-agent particles, fluidizing-agent particles, and colorant particles, and mechanical impacts are given to the mixed powder, to cause the particles to be solidified and melted on each surface of the toner particles to obtain composite particles. Thus, desorption of the heterogonous particles from the surfaces of the composite particles can be prevented.

Specific means includes a method of providing an impact to the mixture by blades rotating at high speed, and a method of inputting the mixture into a high-speed airflow, accelerating the airflow, and impinging particles against each other or composite particles against an appropriate impinging plate. Devices include Ong Mill (manufactured by Hosokawa Micron Corp.), a device which is modified from I-Type Mill (manufactured by Nippon Pneumatic Mfg. Co., Ltd.) and reduces pulverizing air pressure, Hybridization System (manufactured by Nara Kikai Seisakusho), Cryptron System (manufactured by Kawasaki Heavy Industries, Ltd.), and an automatic mortar.

As colorants used for the toner, all dyes and pigments conventionally used as colorant for toner can be used. Examples thereof are carbon black, lamp black, iron black, ultramarine blue, nigrosine dye, aniline blue, phthalocyanine blue, phthalocyanine green, Hansa yellow G, rhodamine 6C lake, chalco-oil blue, chrome yellow, quinacridone red, benzidine yellow, and rose bengal, and these materials can be used singly or in combination.

To further provide magnetic property to the toner particle itself as required, magnetic components of iron oxides such as ferrite, magnetite, and maghemite; metal such as iron, cobalt, and Nickel; or alloys of these materials and other metals may be contained alone or in combination thereof in the toner particle. These components can be also used as colorant components and also used in combination with others.

The number-average particle size of the colorant in the toner is desirably 0.5 micrometer or less, preferably 0.4 micrometer or less, more preferably 0.3 micrometer or less. If the number-average particle size of the colorant in the toner is 0.5 micrometer or more, then dispersion of pigments does not reach an adequate level and preferable transparency cannot sometimes be obtained.

The colorant of a fine particle size smaller than 0.1 micrometer is sufficiently smaller than a half-wavelength of the visible light, and thus, it is considered that the colorant does not affect reflection and absorption properties of light. Therefore, the particles of colorant having a size less than 0.1 micrometer are useful for better color reproducibility and transparency of overhead projector (OHP) sheet with a fixed image thereon.

On the other hand, if there are many colorants having a particle size larger than 0.5 micrometer, transmission of incident light is thereby blocked or the incident light is caused to scatter, and brightness and vividness of a projected image of the OHP sheet thereby tend to lower.

Furthermore, if there are many colorants having a particle size larger than 0.5 micrometer, it is not preferred because the colorants are desorbed from the surface of the toner particle, which easily causes various troubles such as fogging, drum contamination, defective cleaning. Particularly, the number of colorants having a particle size larger than 0.7 micrometer is preferably 10 number % or less of the all colorants, more preferably 5 number % or less.

The colorants and part of or the whole of the binder resin are previously applied with a moisturizing agent and kneaded, and the binder resin and the colorants thereby sufficiently adhere to each other in the initial stage. Thereafter, the colorants are effectively dispersed on a toner particle in a toner manufacturing process, the dispersed particle size of the colorant becomes smaller, and further more transparency can thereby be obtained.

As the binder resin used for kneading in the previous stage, the resin group shown as the binder resin for toner can be used as it is, but the binder resin is not limited thereby.

A specific method of previously kneading the mixture of the binder resin and the colorants with the moisturizing agent includes a method of mixing the binder resin, the colorants, and the moisturizing agent by a blender such as a Henschel mixer, and kneading the mixture by a kneader with two rolls or three rolls at a temperature lower than a melting temperature of the binder resin, to obtain a sample.

As the moisturizing agent, ordinary agents can be used in view of melting property of the binder resin and applying capability with the colorants, and especially, organic solvent such as acetone, toluene, and butanone and water are preferred in terms of dispersion capability of the colorants. Among these materials, water is more preferably used from the view point of environmental concerns and maintenance of dispersion stability of colorants in the following toner manufacturing process.

According to the method, the particle size of the colorant particles contained in the obtained toner becomes small and homogeneity in the dispersed state of the particles increases. Thus, the color reproducibility of an projected image by the OHP becomes further better.

In addition, a release agent such as wax can also be contained together with the binder resin and the colorants in the toner.

As a release agent, known materials can be used. Examples thereof include polyolefin wax (e.g. polyethylene wax and polypropylene wax); long chain hydrocarbon (e.g. paraffin wax and Sasol Wax); and carbonyl group-containing wax.

Preferred one of these is carbonyl group-containing wax. Examples of carbonyl group-containing wax include polyalkanoic acid ester (e.g. carnauba wax, montan wax, trimethylolpropane tribehenate, pentaerythritol tetrabehenate, pentaerythritol diacetate dibehenate, glycerin tribehenate, 1,18-octadecanediol distearate); polyalkanol ester (e.g. trimellitic acid tristearyl, distearyl maleate); polyalkanoic acid amide (e.g. etylenediamine dibehenylamide); polyalkylamide (e.g. tristearylamide trimellitate); and dialkyl ketone (e.g. distearyl ketone).

Among these carbonyl group-containing waxes, preferred one is polyalkanoic acid ester. The melting point of these release agents is usually from 40° C. to 160° C., preferably from 50° C. to 120° C., and more preferably from 60° C. to 90° C. A wax with a melting point of lower than 40° C. may adversely affect the heat-resistance storageability. In contrast, a wax with a melting point of higher than 160° C. may often cause cold offset upon image fixing at low temperatures. The melt viscosity of the wax is preferably from 5 cps to 1000 cps, and more preferably from 10 cps to 100 cps as a measured value at a temperature which is 20° C. higher than its melting point. A wax with a melt viscosity of more than 1000 cps may not satisfactorily contribute to improved hot offset resistance and image-fixing properties at low temperatures. A content of the wax in the toner is usually from 0 wt % to 40 wt %, and preferably from 3 wt % to 30 wt %.

To speed up the charge amount of toner and its start-up, a charge control agent may be contained in the toner according to need. In this case, if a colored material is used as the charge control agent, the color is caused to change, and thus, any material close to monochrome and white color is preferred.

Known charge control agents can be used as a charge control agent, and include, for example, triphenylmethane dyes, chelate molybdate pigment, rhodamine dyes, alkoxy amine, quaternary ammonium salt (including fluorine modified quaternary ammonium salt), alkylamide, phosphorus alone or compounds thereof, tungsten alone or compounds thereof, fluorine-based active agents, salicylic acid metal salts, and metal salts of salicylic acid derivatives. More specific examples of the charge control agents are Bontron P-51 as quaternary ammonium salts, E-82 as oxynaphthoic acid type metal complex, E-84 as salicylic acid metal complex, E-89 as phenol type condensate (these are manufactured by Orient Chemical Industries, Ltd.), TP-302 and TP-415 as quaternary ammonium salt molybdenum complexes (manufactured by Hodogaya Chemical Industries, Ltd.), Copy Charge PSY VP2038 as quaternary ammonium salt and Copy Charge NX VP434 as quaternary ammonium salt (these are manufactured by Hoechst Co., Ltd.), LRA-901 and LR-147 as boron complex (manufactured by Japan Carlit Co., Ltd.), quinacridone, azo type pigments, and polymer compounds having a functional group such as a sulfonic acid group, a carboxyl group, and a quaternary ammonium salt group.

The use amount of the charge control agent is determined depending on the type of binder resins, presence or absence of additives to be used as required, and a method of manufacturing toner including a dispersion method, and hence, it is not uniquely limited. However, the charge control agent is used preferably in a range from 0.1 to 10 parts by weight (wt. parts), and more preferably from 0.2 to 5 wt. parts, per 100 wt. parts of the binder resin. If it exceeds 10 wt. parts, the toner is charged too highly, which causes effects of the charge control agent to be decreased, electrostatic attracting force with a developing roller to be increased, fluidity of the developer to be lowered, and image density to be reduced. These charge control agent can be melted and kneaded with the master batch and the resin and then the mixture can be dissolved and dispersed, or may be directly added to organic solvent at a time of dissolution and dispersion, or may be solidified on the toner surface after toner particles are formed.

When the toner materials are dispersed in the aqueous medium during the toner manufacturing process, resin fine particles may be added to the toner materials to mainly stabilize the dispersion.

The resin fine particles to be use may be of any resin selected from thermoplastic resins and thermosetting resins, if an aqueous dispersion may be formed from the resin fine particles. Examples of the resins include vinyl resins, polyurethane resins, epoxy resins, polyester resins, polyamide resins, polyimide resins, silicon resins, phenol resins, melamine resins, urea resins, aniline resins, ionomer resins, and polycarbonate resins. These resins may be used in combination of two or more types as resin fine particles. Among these, vinyl resins, polyurethane resins, epoxy resins, polyester resins, and combinations thereof are preferred, since aqueous dispersions of resin spherical fine particles can be easily obtained.

Examples of the vinyl resins include polymers in which vinyl monomer is singly polymerized or copolymerized with other monomers, such as styrene-methacrylic ester copolymers, styrene-butadiene copolymers, methacrylic acid-acrylic ester copolymers, styrene-acrylonitrile copolymers, styrene-maleic acid anhydride copolymers, and styrene-methacrylic acid copolymers. However, the vinyl resins are not limited thereby.

Inorganic fine particles are preferably used as an external additive to facilitate fluidity, developing performance, and chargeability of toner particles.

Such an inorganic fine particle has preferably a primary particle diameter of 5 nanometers to 2 micrometers. In particular, the primary particle diameter is preferably 5 to 500 nanometers. A specific surface area by the BET method is preferably 20 $m^2/g$ to 500 $m^2/g$. The use ratio of the inorganic fine particles is preferably 0.01 wt % to 5 wt % in toner particles, and more preferably 0.01 wt % to 2.0 wt %. Specific examples of the inorganic particles include silica, alumina, titanium oxide, barium titanate, magnesium titanate, calcium titanate, strontium titanate, zinc oxide, tin oxide, silica sand, clay, mica, wollastonite, diatomite, chromium oxide, cerium oxide, red iron oxide, antimony trioxide, magnesium oxide, zirconium oxide, barium sulfate, barium carbonate, calcium carbonate, silicon carbide, and silicon nitride.

In addition, there are polymer type fine particles, for example, polystyrene, methacrylic acid ester and acrylic acid ester copolymers, and a polycondensation type such as silicone, benzoguanamine, and nylon, which are prepared by soap-free emulsion polymerization, suspension polymerization, or dispersion polymerization; and polymer particles prepared from thermosetting resin.

These external additives are subjected to surface treatment to increase hydrophobicity, so that deterioration of fluid characteristics and charging characteristics can be prevented even under high humidity. Examples of a preferred surface treatment agent include a silane coupling agent, a silylating agent, a silane coupling agent having a fluorinated alkyl group, an organic titanate type coupling agent, an aluminum type coupling agent, silicone oil, and modified silicon oil.

Examples of a cleaning improving agent to remove a developer remaining on a photosensitive element and a primary transfer medium after an image is transferred therefrom include fatty acid metal salt such as zinc stearate, calcium stearate, and stearic acid; and polymer fine particles such as polymethyl methacrylate fine particles and polystyrene fine particles manufactured by soap-free emulsion polymerization or the like. The polymer fine particles have comparatively narrow particle-size distribution, and particles having a volume-average particle size of 0.01 micrometer to 1 micrometer are preferable.

By using these toner particles, a high-quality toner image excellent in development stability can be formed. However, some toner particles remain on the image carrier without being transferred onto a transfer medium or an intermediate transfer medium by the transfer device. Because it is difficult to remove the toner particles by the cleaning device due to their fineness and high rolling motion, and the toner particles often pass through under the cleaning device. To perfectly remove the toner particles from the image carrier, a toner removing unit such as a cleaning blade needs to be strongly pressed against the image carrier. Such a load results in reduction in lives of the image carrier and the cleaning device and also results in unnecessary energy consumption.

When the load to the image carrier is reduced, removal of the toner particles and small-sized carrier particles from the image carrier becomes insufficient, and these particles give damage to the surface of the image carrier when passing through the cleaning device, which causes the performance of the image forming apparatus to vary.

According to the first embodiment, the image forming apparatus has a wider tolerance to variation in the surface state of the image carrier, especially to a presence at a low resistance portion, and highly suppresses variation in the charging performance to the image carrier. Therefore, by using the toner, the image forming apparatus can stably obtain extremely high-quality images over the long period of time.

The image forming apparatus can use the toner suitable to obtain the high-quality images and also use amorphous toner obtained by a pulverizing method, which can greatly extend the life of the apparatus.

Materials containing the toner due to the pulverizing method are not particularly limited, and thus, the materials generally used for toner for electrophotography can be used.

Examples of ordinary binder resins used for the toner include styrenes such as polystyrene, poly-p-chlorostyrene, and polyvinyltoluene, and substituted homopolymers thereof; styrene copolymers such as styrene-p-chlorostyrene copolymer, styrene-propylene copolymer, styrene-vinyl toluene copolymer, styrene-vinyl naphthalene copolymer, styrene-acrylic acid methyl copolymer, styrene-acrylic acid ethyl copolymer, styrene-acrylic acid butyl copolymer, styrene-acrylic acid octyl copolymer, styrene-methacrylic acid methyl copolymer, styrene-methacrylic acid ethyl copolymer, styrene-methacrylic acid butyl copolymer, styrene-α-chloromethacrylic acid methyl copolymer, styrene-acrylonitrile copolymer, styrene-vinyl methyl ketone copolymer, styrene-butadiene copolymer, styrene-isoprene copolymer, and styrene-maleic acid copolymer; acrylic acid ester homopolymers and copolymers thereof such as polymethyl acrylate, polybutyl acrylate, polymethyl methacrylate, polybutyl methacrylate; polyvinyl derivatives such as polyvinyl chloride, and polyvinyl acetate; polyester polymer, polyurethane polymer, polyamide polymer, polyimide polymer, polyol polymer, epoxy polymer, terpene polymer, fatty series or alicyclic hydrocarbon resin, and aromatic petroleum resin. These materials can be used singly or in combination, but the material for the binder resin is not particularly limited thereby. At least one selected from among styrene-acrylic acid copolymers, polyester resins, and polyol resins is more preferred in terms of electrical properties and cost. Polyester resins and/or polyol resins are more preferably used as one having excellent fixing capability.

From the above-mentioned reasons, if the material is the same as the resin component forming the binder resin of the toner contained in a coating layer of the charging unit, at least one of linear polyester resin composition, linear polyol resin composition, linear styrene acrylic resin composition, or crosslinked products thereof can be preferably used.

The toner obtained by using the pulverizing method is formed simply by being subjected to the following processes in which the colorant components, the wax components, and the charge controlling components are mixed together with these resin components as required, the mixture is kneaded at a temperature near or less than the melting temperature of the resin components, the kneaded mixture is cooled down, and then it reaches a pulverizing/classifying process. The external additives may be added thereto and mixed according to need.

Examples 1-1 TO 1-3 and Comparative Example 1-1

The photosensitive element was covered with the protective agent under the following conditions, and the adhesion amount of the protective agent was measured.

(1) Protective Agent

Normal paraffin of 79 wt. parts whose melting temperature is 106° C., normal paraffin of 10 wt. parts whose melting temperature is 112° C., and cyclic polyolefin TOPAS™ (softening temperature 60° C., manufactured by Ticona Co.) of 11 wt. parts were put into a glass container with a lid, and stirred and melted by a hot stirrer in which temperature was controlled to 125° C. (composition of protective agent Formula 1-1).

The melted composition of the protective agent Formula 1-1 was poured into an aluminum-made die having previously been heated to 88° C. to be filled therewith. The die had inner dimensions of 12 mm×8 mm×350 mm. The composition was cooled down to 50° C. in room-temperature atmosphere, and then the composition was again heated up to 60° C. in a temperature-controlled bath in which the temperature was set, and was left for 20 minutes at the same temperature, and thereafter, the composition was cooled down to the room temperature. After cooled down, a solid matter was removed from the die, was cut to prepare a mold of 7 mm×8 mm×310 mm, and was adhered to a metal support by a double-stick tape.

(2) Photosensitive Element

An undercoat layer, a charge generation layer, a charge transport layer, and a protective layer were applied in this order to an aluminum drum (conductive support) having a diameter of 40 millimeters, and were dried to prepare a photosensitive element containing an undercoat layer of 3.6 micrometers, a charge generation layer of 0.15 micrometer, a charge transport layer of 25 micrometers, and a protective layer of about 3.7 micrometers. In this case, the protective layer was applied by a spray method while the other layers were applied by a dip coating method. Alumina having an average particle size of 0.16 micrometer was added by 23.5 mass % to the protective layer. The surface roughness (Rz jis) of the photosensitive element at this time was set to 0.25 micrometer to 0.4 micrometer.

(3) Application of Protective agent

The protective agent and the photosensitive element manufactured in the above manner were set in protective-agent applying devices 2-1 to 2-4 having configuration basically as shown in FIG. 1. A pressure to press the protective agent against the brush was changed in four stages: 0.9 newton, 2.1 newton, 3.6 newton, and 4.9 newton, and the protective agent was applied to the photosensitive element for 10 minutes and 60 minutes. A brush for use in this case was prepared, through electrostatic flocking, by using conductive polyesters of which thickness is 31 micrometers on average and length is 2.0 millimeters. In order from the protective-agent applying devices 2-4, 2-1, 2-2, and 2-3, the pressure to press the protective agent against the brush is smaller.

(4) Measurement of Protective-Agent Adhesion Amount

The amount of adhesion of the protective agent to the photosensitive element was measured by using the IAMS Mass Spectrometer (L-240G-IA, manufactured by Anelva Corp.). The results are shown in Table 1.

TABLE 1

| | | Adhesion amount (μg/cm$^2$) | |
|---|---|---|---|
| | Protective-agent applying device | Applied for 10 minutes | Applied for 60 minutes |
| Example 1-1 | Protective-agent applying device 2-1 | 0.59 | 3.7 |
| Example 1-2 | Protective-agent applying device 2-2 | 0.72 | 4.1 |
| Example 1-3 | Protective-agent applying device 2-3 | 1.4 | 4.5 |

TABLE 1-continued

| | Protective-agent applying device | Adhesion amount (μg/cm²) Applied for 10 minutes | Applied for 60 minutes |
|---|---|---|---|
| Comparative Example 1-1 | Protective-agent applying device 2-4 | 0.47 | 1.8 |

Next, four units for each of the protective-agent applying devices 2-1 to 2-4 were each set in a color multifunction product (MFP): imagio Neo C600 manufactured by RICOH COMPANY, LTD. which was modified so that each of the protective-agent applying devices 2-1 to 2-4 was able to be incorporated therein. A test on image formation was conducted in such a manner that an A4-size color document in horizontal orientation having an image area ratio of 4.5% was continuously printed by 5 sheets each, 5,000 sheets in total in an environment of 23° C./55% RH. It was checked whether the images were normal before and after the test was conducted, in an environment with normal-temperature and normal-humidity conditions of 23° C./55% RH, and an environment with high-temperature and high-humidity conditions of 28° C./80% RH. At this time, toner for use in the test was manufactured by a polymerization method. More specifically, the toner had a weight-average particle size (D4)=5.1 micrometers, a number-average particle size (D1)=4.4 micrometers, and a circularity SR=0.98.

Images were formed in the normal-temperature and normal-humidity environment and the high-temperature and high-humidity environment by the image forming apparatus using the protective-agent applying devices 2-1 to 2-3, and the formed images were high-quality images. However, the images formed by the image forming apparatus using the protective-agent applying device 2-4 were found to be defective images with fine spots in all halftone images obtained in the normal-temperature and normal-humidity environment and the high-temperature and high-humidity environment.

Example 1-4 and Comparative Example 1-2

Conditions of a starting material of the protective-agent manufacturing conditions according to Example 1-1 were determined as normal paraffin of 65 wt. parts whose melting temperature was 133° C., normal paraffin of 22 wt. parts whose melting temperature was 108° C., and cyclic polyolefin TOPAS™ (softening temperature 60° C., manufactured by Ticona Co.) of 13 wt. parts. The rest of materials were the same as these in Example 1-1 to prepare a protective agent.

The protective agents of the protective-agent applying devices 2-2 and 2-3 were respectively replaced with the protective agent prepared as above, and the replaced protective agent was set in the protective-agent applying devices 2-2 and 2-3 (hereinafter, protective-agent applying devices 2-5 and 2-6, respectively). The protective-agent applying devices 2-5 and 2-6 were used to apply the protective agent in the same manner as in Example 1-1, and a protective-agent adhesion amount was measured. The results are shown in Table 2.

TABLE 2

| | Protective-agent applying device | Adhesion amount (μg/cm²) Applied for 10 minutes | Applied for 60 minutes |
|---|---|---|---|
| Example 1-4 | Protective-agent applying device 2-6 | 0.56 | 3.6 |
| Comparative Example 1-2 | Protective-agent applying device 2-5 | 0.41 | 1.6 |

Next, four units for each of the protective-agent applying devices 2-5 and 2-6 were prepared, image forming apparatuses were manufactured by using the protective-agent applying devices 2-5 and 2-6 in the same manner as in Example 1-1, and evaluation was made on image formation. A test on the image formation was conducted in such a manner that an A4-size color document in horizontal orientation having an image area ratio of 5% was continuously printed by 5 sheets each, 7,000 sheets in total in an environment of 23° C./55% RH. It was checked whether the images were normal before and after the test was conducted, in an environment with normal-temperature and normal-humidity conditions of 20° C./50% RH, and an environment with high-temperature and high-humidity conditions of 30° C./85% RH.

When the protective-agent applying device 2-6 was used in the image forming apparatus, images with no problem for actual use were obtained in the both environments, however, fine streaks were faintly visible in the images when looked at carefully. On the other hand, when the protective-agent applying device 2-5 was used in the image forming apparatus, defective images with fine streaks could be seen in the both environments.

Examples 1-5 and 1-6

Conditions of a starting material of the protective-agent manufacturing conditions according to Example 1-1 were determined as normal paraffin of 55 wt. parts whose melting temperature was 126° C., normal paraffin of 22 wt. parts whose melting temperature was 108° C., cyclic polyolefin TOPAS™ (softening temperature 60° C., manufactured by Ticona Co.) of 13 wt. parts, and polytetrafluoroethylene particles of 10 wt. parts. The rest of materials were the same as these in Example 1-1 to prepare a protective agent.

The protective agents of the protective-agent applying devices 2-6 and 2-5 were replaced with the protective agent prepared as above, and the replaced protective agent was set in the protective-agent applying devices 2-6 and 2-5 (hereinafter, protective-agent applying devices 2-7 and 2-8, respectively). The protective-agent applying devices 2-7 and 2-8 were used to apply the protective agent in the same manner as in Example 1-1, and a protective-agent adhesion amount was measured. The results are shown in Table 3.

TABLE 3

| | Protective-agent applying device | Adhesion amount (μg/cm²) Applied for 10 minutes | Applied for 60 minutes |
|---|---|---|---|
| Example 1-5 | Protective-agent applying device 2-7 | 0.71 | 4.0 |

TABLE 3-continued

| | Protective-agent applying device | Adhesion amount (μg/cm²) Applied for 10 minutes | Applied for 60 minutes |
|---|---|---|---|
| Example 1-6 | Protective-agent applying device 2-8 | 1.3 | 4.3 |

Next, four units for each of the protective-agent applying devices 2-7 and 2-8 were prepared, image forming apparatuses were manufactured by using the protective-agent applying devices 2-7 and 2-8 in the same manner as in Example 1-1, and evaluation was made on image formation. A test on the image formation was conducted in such a manner that an A4-size color document in horizontal orientation having an image area ratio of 5% was continuously printed by 5 sheets each, 7,000 sheets in total in an environment of 23° C./55% RH. It was checked whether the images were normal before and after the test was conducted, in an environment with normal-temperature and normal-humidity conditions of 20° C./50% RH, and an environment with high-temperature and high-humidity conditions of 30° C./85% RH. In the both environments, high-quality images were obtained.

Example 1-7

Conditions of a starting material of the protective-agent manufacturing conditions according to Example 1-1 were determined as normal paraffin of 55 wt. parts whose melting temperature was 66° C., normal paraffin of 32 wt. parts whose melting temperature was 108° C., and cyclic polyolefin TOPAS™ (softening temperature 60° C., manufactured by Ticona Co.) of 13 wt. parts. The rest of materials were the same as these in Example 1-1 to prepare a protective agent.

The protective agent of the protective-agent applying device 2-1 was replaced with the protective agent prepared as above, and the replaced protective agent was set in the protective-agent applying device 2-1 (hereinafter, protective-agent applying device 2-9). The protective-agent applying device 2-9 was used to apply the protective agent in the same manner as in Example 1-1, and a protective-agent adhesion amount was measured. Each adhesion amount was as follows: 2.3 μg/cm² (applied for 10 minutes) and 7.6 μg/cm² (applied for 60 minutes).

Next, four units of the protective-agent applying device 2-9 were prepared, image forming apparatus were manufactured by using the four protective-agent applying devices 2-9 in the same manner as in Example 1-1, and evaluation was made on image formation. A test on the image formation was conducted in such a manner that an A4-size color document in horizontal orientation having an image area ratio of 7% was continuously printed by 5 sheets each, 4,000 sheets in total in an environment of 28° C./55% RH. It was checked whether the images were normal before and after the test was conducted, in an environment with normal-temperature and normal-humidity conditions of 20° C./50% RH, and an environment with high-temperature and high-humidity conditions of 30° C./85% RH. As a result, images with no problem for actual use were obtained, however, uneven shading was faintly visible in the images when looked at carefully.

Comparative Example 1-3

A brush obtained in the following manner is replaced with the brush used for the protective-agent applying device 2-9. The brush is obtained by bundling 50 conductive polyester fibers each having a diameter of about 4 micrometers, and heating the bundled fibers to be processed to obtain a line of fiber having a length of 2 millimeters through electrostatic flocking. A protective-agent applying device 2-10 having the replaced brush and having the rest of materials the same as that of the protective-agent applying device 2-9 was prepared. The protective-agent applying device 2-10 was used to apply the protective agent in the same manner as in Example 1-1, and a protective-agent adhesion amount was measured. Each adhesion amount was as follows: 0.61 μg/cm² (applied for 10 minutes) and 8.4 μg/cm² (applied for 60 minutes).

Next, four units of the protective-agent applying device 2-10 were prepared, image forming apparatuses were manufactured by using the four protective-agent applying device 2-10 in the same manner as in Example 1-1, and evaluation was made on image formation. A test on the image formation was conducted in such a manner that an A4-size color document in horizontal orientation having an image area ratio of 7% was continuously printed by 5 sheets each, 4,000 sheets in total in an environment of 28° C./55% RH. It was checked whether the images were normal before and after the test was conducted, in an environment with normal-temperature and normal-humidity conditions of 20° C./50% RH, and an environment with high-temperature and high-humidity conditions of 30° C./85% RH. As a result, fine uneven shading was visible in the images in the both environments.

Example 1-8

A protective agent was prepared with normal paraffin whose melting temperature was 74° C. instead of normal paraffin whose melting temperature was 66° C. of the protective-agent manufacturing conditions in Example 1-7. The rest of materials were the same as these in Example 1-7.

The protective agent of the protective-agent applying device 2-9 was replaced with the protective agent prepared as above, and the replaced protective agent was set in the protective-agent applying device 2-9 (hereinafter, protective-agent applying device 2-11). The protective-agent applying device 2-11 was used to apply the protective agent in the same manner as in Example 1-1, and a protective-agent adhesion amount was measured. Each adhesion amount was as follows: 1.2 μg/cm² (applied for 10 minutes) and 5.9 μg/cm² (applied for 60 minutes).

Next, four units of the protective-agent applying device 2-11 were prepared, image forming apparatuses were manufactured by using the four protective-agent applying devices 2-11 in the same manner as in Example 1-1, and evaluation was made on image formation. A test on the image formation was conducted in such a manner that an A4-size color document in horizontal orientation having an image area ratio of 7% was continuously printed by 5 sheets each, 4,000 sheets in total in an environment of 28° C./55% RH. It was checked whether the images were normal before and after the test was conducted, in an environment with normal-temperature and normal-humidity conditions of 20° C./50% RH, and an environment with high-temperature and high-humidity conditions of 30° C./85% RH. As a result, images with no problem for actual use were obtained.

Comparative Example 1-4

A protective-agent applying device 2-12 is prepared with a brush which had the same specification as the brush used for the protective-agent applying device 2-1 and of which manufacturing lot was manufactured five month ago. The rest of materials were the same as these of the protective-agent applying device 2-1. The protective-agent applying device 2-12 was used to apply the protective agent in the same manner as in Example 1-1, and a protective-agent adhesion amount was measured. Each adhesion amount was as follows: 0.49 $\mu g/cm^2$ (applied for 10 minutes) and 3.0 $\mu g/cm^2$ (applied for 60 minutes).

Next, four units of the protective-agent applying device 2-12 were prepared, an image forming apparatus were manufactured in the same manner as in Example 1-1 except for using the prepared protective-agent applying device 2-12, and a test on image formation was conducted in the same manner as in Example 1-1. As a result, defective images with fine spots could be seen in all halftone images obtained in both the normal-temperature and normal-humidity environment and the high-temperature and high-humidity environment.

Explained below is a second embodiment of the present invention. A protective-agent applying device, a process cartridge, and an image forming apparatus of the second embodiment is of configuration basically the same as those previously described in connection with FIGS. 1 to 3. An image carrier as a photosensitive element is basically the same as that of the first embodiment.

To examine factors of occurrence of defective images, the inventors thought that adhesion amounts of the protective agent might be different from each other in a location where a defective image was formed and a location where no defective image was formed, and checked each adhesion amount of the protective agent on the photosensitive element. As a result, the factors could not clearly be specified because there were cases in which the images were defective in many locations and in which the images were defective in not many locations.

The inventors further thought that occurrence mechanisms of defective images might be different from each other depending on formed images, and observed, in detail, locations where defective images were formed. As a result, when an image area of a formed image is small, then the toner components adhere to the photosensitive element and the resolution of the image thereby often decreases, while when an image area of a formed image is large, then the photosensitive element partially wears, which easily causes an image to be defective. As explained above, because the ways of occurrence of defective images are different depending on the formed images, the inventors thought that applied states of the protective agent might be different from each other when the protective agent would only be deposited on the photosensitive element without image formation. Then, the applied states were subjected to XPS analysis in the same manner as the case of the metallic soap. However, in the XPS, it is impossible to calculate a coverage from the amount of metal because the protective agent does not contain a metal element.

Thus, to obtain an index to figure out an amount of protective agent deposited on the photosensitive element even if the protective agent such as paraffin not containing metal was used, it was further studied whether the amount of protective agent could be obtained by tracking not components contained in the protective agent but components contained only in the photosensitive element. In other words, if the index indicating components contained only in the photosensitive element decreases by applying the protective agent thereto, this means that the protective agent covers the photosensitive element.

An analysis method suitable for tracking of the components contained only in the photosensitive element was examined. As a result, when the photosensitive element without the protective agent and containing polycarbonate resin was subjected to the XPS analysis and wavelengths in different bonding states of carbon in a detected C1s spectrum were separated, peaks having peak tops in the range of 290.3 electron volts to 294 electron volts could be separated.

However, the photosensitive element containing polycarbonate resin was subjected to the XPS analysis after a sufficient amount of protective agent was applied thereto. As a result, it was found that the peaks existing in the range of 290.3 electron volts to 294 electron volts disappeared. Alternatively, it was found that a ratio of a total area of peaks having peak tops in the range of 290.3 electron volts to 294 electron volts to an area of the entire C1s spectrum became much smaller than a ratio of that when the photosensitive element was subjected to the XPS analysis before the protective agent was applied thereto. The peak mentioned here indicates a curve expressed by either one of or both of a Gaussian function and a Lorenz function, and the peak top indicates a vertex of the curve.

Next, it was checked whether a satisfactory state of the protective agent on the photosensitive element after the protective agent was applied by using the protective-agent applying device could be specified by using the coverage. As a result, it was found that by setting a photosensitive element coverage $((A_0-A_t)/A_0\times100)$ (%) to a preferred range, an output of a high quality image can be maintained.

More specifically, the protective-agent applying device applies the protective agent containing paraffin as the main component to the photosensitive element in which a ratio ($A_0$) of a sum (total area) of areas of peaks (initial peak) having peak tops in the range of 290.3 electron volts to 294 electron volts to an area of the entire C1s spectrum is 3% or more. Specifically, the peaks are obtained by separating wavelengths produced from different bonding states of carbon, according to binding energy, in the C1s spectrum obtained by the XPS analysis of the initial surface of the photosensitive element. The protective-agent applying device is configured to set application conditions so that a ratio ($A_t$) of a sum (total area) of areas of peaks (peak at an application time t) having peak tops in the range of 290.3 electron volts to 294 electron volts to the area of the entire C1s spectrum decreases by a predetermined ratio or more specified from the area ratio ($A_0$) corresponding to a predetermined time t. Specifically, the peaks are obtained by separating wavelengths produced from different bonding states of carbon, according to binding energy, in the C1s spectrum obtained by the XPS analysis of the surface of the photosensitive element after the protective agent is applied for the predetermined time t.

In other words, in the protective-agent applying device that applies the protective agent containing paraffin as the main component to the photosensitive element, the application conditions are set so that when the protective agent is applied to the photosensitive element for the predetermined time t, a coverage of the protective agent over the photosensitive element calculated by following Equation (1) is a predetermined value or more.

$$\text{(Coverage of protective agent)}=(A_0-A_t)/A_0\times100(\%) \quad (1)$$

where $A_0$ is a ratio of a sum (total area) of areas of peaks having peak tops in the range of 290.3 electron volts to 294 electron volts to an area of the entire C1s spectrum (the peaks are obtained by separating wavelengths produced from different bonding states of carbon, according to binding energy, in the C1s spectrum obtained by the XPS analysis of the initial surface of the photosensitive element), and $A_t$ is a ratio of a sum (total area) of areas of peaks having peak tops in the range of 290.3 electron volts to 294 electron volts to the area of the entire C1s spectrum after the protective agent is applied (the peaks are obtained by separating wavelengths produced from different bonding states of carbon, according to binding energy, in the C1s spectrum obtained by the XPS analysis of the surface of the photosensitive element after the protective agent is applied to the photosensitive element for the predetermined time t).

Furthermore, the application conditions are set so that a ratio ($A_3$) satisfies the following Equation (2), and a ratio ($A_{10}$) satisfies the following Equation (3). More specifically, the ratio ($A_3$) is a ratio of a sum (total area) of areas of peaks having peak tops in the range of 290.3 electron volts to 294 electron volts to an area of the entire C1s spectrum, the peaks being obtained by separating wavelengths produced from different bonding states of carbon, according to binding energy, in the C1s spectrum obtained by the XPS analysis of the surface of the photosensitive element after the protective agent is applied for 3 minutes. The ratio ($A_{10}$) is a ratio of a sum (total area) of areas of peaks having peak tops in the range of 290.3 electron volts to 294 electron volts to an area of the entire C1s spectrum, the peaks being obtained by separating wavelengths produced from different bonding states of carbon, according to binding energy, in the C1s spectrum obtained by the XPS analysis of the surface of the photosensitive element after the protective agent is applied for 10 minutes.

$$(A_0-A_3)/A_0\times 100\geqq 40 \quad (2)$$

$$(A_0-A_{10})/A_0\times 100\geqq 60 \quad (3)$$

In other words, these equations indicate that the application conditions are set so that the coverage of the protective agent becomes 40% or more when the protective agent is applied to the photosensitive element for 3 minutes and the coverage of the protective agent becomes 60% or more when it is applied for 10 minutes.

A difference ($A_0-A_t$) between the area ratio ($A_t$) of an area of the peak at the application time t and the area ratio ($A_0$) of an area of the initial peak indicates a decreased amount of the peak before and after the protective agent is applied. Therefore, the decreased amount ($A_0-A_t$) is divided by the area ratio ($A_0$) of the area of the peak before the protective agent is applied, to obtain a decreasing rate of the area ratio ($A_t$) to the area ratio ($A_0$) of the area before the protective agent is applied. When the decreasing rate is greater, then the larger part of the photosensitive element is covered, and when the photosensitive element is fully covered with the protective agent, then the peak completely disappears and the decreasing rate becomes 100%.

The photosensitive element contains polycarbonate, and the peak having the peak top in the range of 290.3 electron volts to 294 electron volts is a peak appearing caused by carbonate bonding in the polycarbonate resin and a charge transport material (CTM) in the photosensitive element or caused by $\pi-\pi^*$transition of a benzene ring in the polycarbonate resin. However, it is considered that the peak having the peak top in the range of 290.3 electron volts to 294 electron volts decreases or disappears because the surface of the photosensitive element is covered with the protective agent containing paraffin by being applied to the photosensitive element and an exposed portion of the photosensitive element thereby decreases.

Therefore, a rate of the exposed portion of the photosensitive element can be determined by the decreasing rate of an area ratio of the sum (total area) of areas of peaks having peak tops in the range of 290.3 electron volts to 294 electron volts to an area of the entire C1s spectrum. By using such an evaluation method as above, it is possible to determine the rate of exposed portion of the photosensitive element even if the protective agent does not contain metal, and thus this evaluation method is not much affected by types of the protective agent.

When the applied state of the protective agent is determined, the depth detected by an analyzer becomes extremely important. More specifically, when an analyzed depth is too deep, only a signal indicating the photosensitive element may be strongly detected if the surface of the photosensitive element is very thinly covered with the protective agent. As explained above, the XPS detects only a depth of 5 nanometers to 8 nanometers from the extreme surface, and thus the XPS is highly preferable as a method of analyzing the state of the protective agent thinly deposited on the photosensitive element.

According to the second embodiment, when the protective agent is applied for 3 minutes, the coverage of the protective agent ($(A_0-A_t)/A_0\times 100$) in the protective-agent applying device is in a range of 40% to 100%, preferably 43% to 100%, and more preferably 45% to 100%. If the coverage of the protective agent upon application of the protective agent for 3 minutes is less than 40%, it is not preferred because the speed at which the protective agent covers the photosensitive element is too slow. Therefore, when the protective-agent applying device is used for the image forming apparatus, the photosensitive element is not sufficiently protected from the AC charging, and the friction between the photosensitive element and the cleaning blade partially increases, which easily causes a defective image.

Furthermore, when the protective agent is applied for 10 minutes, the coverage of the protective agent in the protective-agent applying device is in a range of 60% to 100%, preferably 70% to 100%, and more preferably 80% to 100%. If the coverage of the protective agent upon application of the protective agent for 10 minutes is less than 60%, it is not preferred because the speed at which the protective agent covers the photosensitive element is too slow. Therefore, when the protective-agent applying device is used for the image forming apparatus, the photosensitive element is not sufficiently protected from the AC charging, and the friction between the photosensitive element and the cleaning blade partially increases, which easily causes a defective image.

Originally, it is ideal to cover the entire surface of the photosensitive element with the protective agent and therefore the coverage of the protective agent in the protective-agent applying device is 100% when the protective agent is applied for 3 minutes and 10 minutes. However, in actual image formation, the protective agent is pressed and spread by toner or the like upon image formation, and thus even if the coverage is the lower limit, the photosensitive element can be satisfactorily protected. Furthermore, there are various types of protective-agent applying device such as one in which even if the coverage is high right after the start of the application, the coverage does not increase thereafter, and one in which even if the coverage is low right after the start of the application, the coverage linearly increases thereafter. It is therefore difficult to simply express the application speed. For example, there is also a protective-agent applying device in which even if the coverage is more than a predetermined value obtained by a single application time, a defective image may be formed. However, if the coverage is in the ranges when the protective agent is applied for 3 minutes and 10 minutes, then no defective images are formed.

The photosensitive element of which coverage is measured by using the above method is broken, and thus it cannot be used any more. However, protective-agent applying devices of the manufacturing lot under the same condition may be equivalent to each other, but even if it is under the same condition, the coverage changes depending on the manufacturing lot of a material to be used. Therefore, image formation may often cause a defective image, and thus it is preferable to check in each same manufacturing lot whether a manufactured protective-agent applying device can maintain the coverage.

According to the second embodiment, the protective agent used in the protective-agent applying device mainly contains paraffin.

The protective agent used in the protective-agent bar of the protective-agent applying device mainly contains paraffin whose melting point is in a range of 50° C. to 130° C., preferably 60° C. to 125° C., more preferably 70° C. to 120° C. If the melting point of the paraffin is 60° C. or less, then the protective agent is easily deformed due to its storage under high temperature, while if it is 150° C. or more, then the application performance to the photosensitive element extremely decreases, thus, the both cases are not preferred. The melting point of the paraffin indicates a temperature of an endothermic peak due to melting of the paraffin when the temperature is increased (e.g., temperature-increasing speed: 10° C./min) using Differential Scanning Calorimeter (for example, DSC-60 manufactured by Shimadzu Corp.).

Examples of the paraffin used for the protective agent are normal paraffin and isoparaffin. The paraffin may be used singly or may be used in combination of different types of paraffin.

The rate of the paraffin in the protective agent is in a range of 40 wt % to 100 wt %, preferably 50 wt % to 95 wt %, and more preferably 60 wt % to 93 wt %. If the rate of the paraffin is less than 40 wt %, this is not preferable because the function as the protective agent is low and the photosensitive element is easily worn upon image formation.

Furthermore, examples as materials other than the paraffin used for the protective-agent bar include an amphiphilic organic compound, and a hydrocarbon group which is classified into aliphatic unsaturated hydrocarbon, alicyclic saturated hydrocarbon, alicyclic unsaturated hydrocarbon, and aromatic hydrocarbon. In addition to the hydrocarbon group, the examples also include fluororesin and fluoro wax group such as polytetrafluoroethylene (PTFE), polyperfluoroalkylether (PFA), perfluoroethylene-perfluoropropylene copolymer (FEP), polyvinylidene fluoride (PVdF), and ethylene-tetrafluoroethylene copolymer (ETFE); silicone resin and a silicone wax group such as polymethylsilicone and polymethylphenylsilicone; and an inorganic compound such as mica having lubricating capability. The examples are not limited by these materials, however, particularly preferable ones among these are the amphiphilic organic compound and the alicyclic saturated hydrocarbon. Because by containing these materials in the protective agent, the application performance of the protective agent is improved, and the photosensitive element can be thinly coated with the protective agent containing the alicyclic saturated hydrocarbon such as cyclic polyolefin in particular. These compounds other than paraffin may be used singly or as a mixture of various types of the compounds.

Examples of the alicyclic saturated hydrocarbon include cycloparaffin and cyclic polyolefin.

The amphiphilic organic compound is classified into an anionic surfactant, a cationic surfactant, a zwitterionic surfactant, a nonionic surfactant, and a compound thereof. The protective agent is required to prevent a bad influence from being exerted on the electrical property of the image carrier to form the protective-agent layer on the image carrier and perform an imaging process. By using the nonionic surfactant among these as the amphiphilic organic compound, there is no ionic dissociation in the surfactant itself. Therefore, even if the use environment, particularly, humidity largely changes, charge leakage due to aerial discharge can be suppressed, and high image quality can be maintained.

The nonionic surfactant is preferably an esterified product of an alkyl carboxylic acid and a polyalcohol group based on Formula (1) as explained above.

By using a straight-chain alkyl carboxylic acid as an alkyl carboxylic acid of Formula (1), a hydrophobic portion of the amphiphilic organic compound is easily arrayed on the surface of the image carrier where the amphiphilic organic compound is adsorbed, and the adsorption density to the surface of the image carrier particularly increases, which is a preferable mode.

Alkyl carboxylate in one molecule shows hydrophobic property. If there is a larger number of alkyl carboxylates, it is more effective to prevent adsorption of a dissociated substance produced due to aerial discharge to the surface of the image carrier and to reduce the electrical stress to the surface of the image carrier in a charging area. However, if a proportion of the alkyl carboxylates occupied therein is too much, the portion of a polyalcohol group indicating hydrophilic property is hidden, and sufficient adsorption capability does not sometimes come out depending on the surface state of the image carrier. Therefore, the average number of ester bonds per molecule of the amphiphilic organic compound is preferably in a range of 1 to 3.

The average number of ester bonds per molecule of the amphiphilic organic compound can also be adjusted by selecting at least one type from a plurality of amphiphilic organic compounds having different number of ester bonds and combining the selected ones.

As explained above, examples of the amphiphilic organic compound include an anionic surfactant, a cationic surfactant, a zwitterionic surfactant, and a nonionic surfactant.

Examples of the anionic surfactant include compounds containing anion at the end of a hydrophobic portion such as alkylbenzene sulfonate, α-olefin sulfonate, alkane sulfonate, alkyl sulfate, alkyl polyoxyethylene sulfate, alkyl phosphate, long-chain fatty acid salt, α-sulfo fatty acid ester salt, and alkyl ether sulfate; and bonding the anion to alkali metal ion such as natrium and kalium, alkali earth metal ion such as magnesium and calcium, metal ion such as aluminum and zinc, and to ammonium ion.

Examples of the cationic surfactant include compounds containing cation at the end of a hydrophobic portion such as alkyltrimethyl ammonium salt, dialkyldimethyl ammonium salt, and alkyldimethyl benzyl ammonium salt; and boding the cation to chlorine, fluorine, bromine, phosphate ion, nitrate ion, sulfate ion, thiosulfate ion, carbonate ion, and to hydroxy ion.

Examples of the zwitterionic surfactant include dimethylalkylamine oxide, N-alkylbetaine, imidazoline derivative, and alkyl amino acid.

Examples of the nonionic surfactant include alcohol compounds, ether compounds, and amide compounds such as long-chain alkyl alcohol, alkyl polyoxyethylene ether, polyoxyethylene alkyl phenyl ether, fatty acid diethanol amide, alkyl polyglucoxide, and polyoxyethylene sorbitan alkyl ester. Preferred examples thereof are long-chain alkyl carboxylic acid such as lauric acid, palmitic acid, stearic acid, behenic acid, lignoceric acid, cerotic acid, montan acid, and melissic acid; a polyalcohol group such as ethylene glycol, propylene glycol, glycerin, erythritol, and hexitol; and ester compounds with a partial anhydride of any of these examples.

The ester compounds are specifically described in the "more specific examples" thereof and thus, explanation is omitted.

Figure 4:
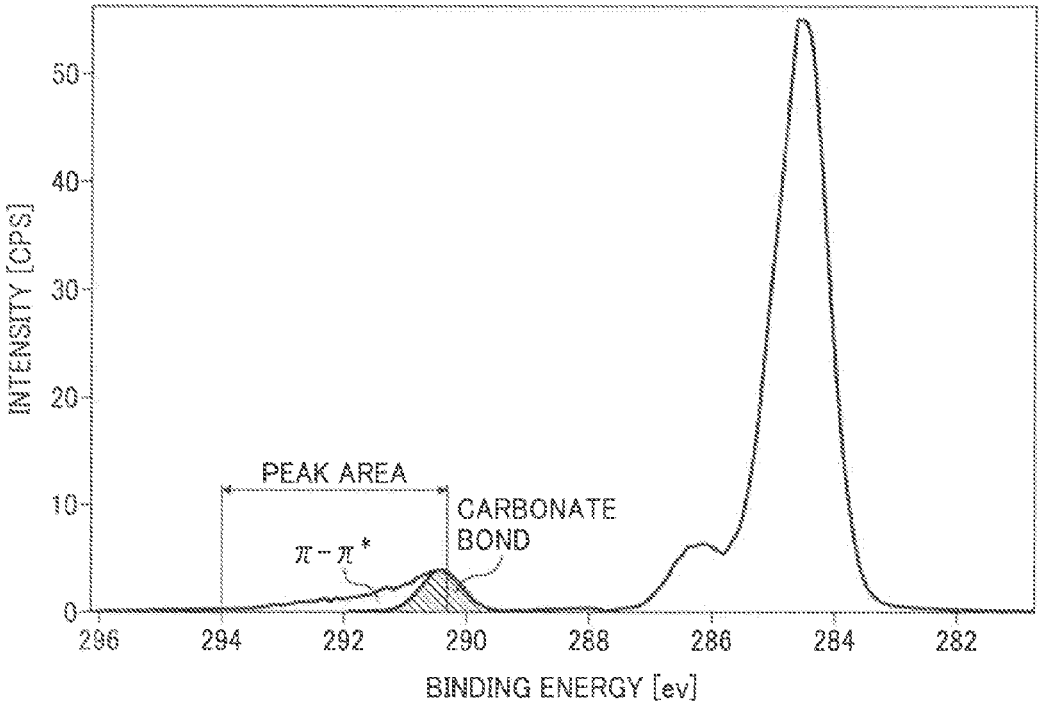
FIG. 4 is a graph indicating a result of XPS analysis of an initial surface of a photosensitive element.

Analysis of Photosensitive Element Before Application of Protective Agent:

FIG. 4 is a graph indicating a C1s spectrum by XPS analysis of the photosensitive element.

The XPS analysis (AXIS ULTRA, Shimadzu/KPATOS, X-ray source: Mono A1, and analysis region: 700×300 μm) was performed on the photosensitive element 1 before the protective agent was applied thereto, to obtain the C1s spectrum as shown in FIG. 4. For the C1s spectrum, a total area of peaks (initial peak) having peak tops in the range of 290.3 electron volts to 294 electron volts (range indicated by arrows in FIG. 4) was calculated by separating wavelengths in different bonding states of carbon from each other, and a ratio (area ratio $A_0$) of the area to the area of the wavelengths of the entire C1s spectrum was calculated as 7.5%.

As shown in FIG. 4, the peak detected in the range of 290.3 electron volts to 294 electron volts (peak top) is separated into a peak (shaded portion) due to a carbonate bond and into a peak (portion adjacent to the left side of the shaded portion) due to the π–π*transition. Further, the peak due to the π–π*transition includes some peaks which are superimposed on each other. It is therefore quite troublesome to separate these peaks from each other and it takes time for the separation upon calculation of the area. Thus the wavelengths seen in the range of 290.3 electron volts to 294 electron volts (peak top) were not separated but were calculated as a block of area.

As explained above, the wavelengths for the peaks seen in the range of 290.3 electron volts to 294 electron volts (peak top) were not separated but were calculated as a block of area, however, if the peaks seen in this range (peak top) overlap the bottoms of the peaks seen in 290.3 electron volts (peak top) or less and in 294 electron volts (peak top) or more, individual peaks need to be separated from each other to calculate an area.

As with the image carrier (photosensitive element) 1, the XPS analysis was performed on 43 photosensitive elements before the protective agent was applied, and an area ratio ($A_0$) of the peak area of the peak to the area of the entire C1s spectrum was calculated. As a result, the area ratio was in a range of 7.9% to 8.9%. The peaks seen in the range of 290.3 electron volts to 294 electron volts (peak top) in the C1s spectrum obtained by each XPS analysis of the photosensitive elements did not overlap the bottoms of peaks seen in 290.3 electron volts (peak top) or less and in 294 electron volts (peak top) or more. Therefore, the wavelengths seen in the range of 290.3 electron volts to 294 electron volts were determined as an area of one block, and the area was calculated.

Examples 2-1 to 2-3 and Comparative Example 2-1

The photosensitive element was covered with the protective agent under the following conditions, and the coverage was measured.

(1) Protective Agent

Normal paraffin of 77 wt. parts whose melting temperature was 106° C., normal paraffin of 12 wt. parts whose melting temperature was 112° C., and cyclic polyolefin TOPAS™ (softening temperature 60° C., manufactured by Ticona Co.) of 11 wt. parts were put into a glass container with a lid, and stirred and melted by a hot stirrer in which temperature was controlled to 125° C. (composition of protective agent Formula 2-1).

The melted composition of the protective agent Formula 2-1 was poured into an aluminum-made die having previously been heated to 88° C. to be filled therewith. The die had inner dimensions of 12 mm×8 mm×350 mm. The composition was cooled down to 50° C. in room-temperature atmosphere, and then the composition was again heated up to 60° C. in a temperature-controlled bath in which the temperature was set, and was left for 20 minutes at the same temperature, and thereafter, the composition was cooled down to the room temperature. After cooled down, a solid matter was removed from the die, was cut to prepare a mold of 7 mm×8 mm×310 mm, and was adhered to a metal support by a double-stick tape.

(2) Photosensitive Element

An undercoat layer, a charge generation layer, a charge transport layer, and a protective layer were applied in this order to an aluminum drum (conductive support) having a diameter of 40 millimeters, and were dried to prepare a photosensitive element containing an undercoat layer of 3.6 micrometers, a charge generation layer of 0.15 micrometer, a charge transport layer of 25 micrometers, and a protective layer of about 3.7 micrometers. In this case, the protective layer was applied by a spray method while the other layers were applied by a dip coating method. Alumina having an average particle size of 0.18 micrometer was added by 23.5 mass % to the protective layer. The surface roughness (Rz jis) of the surface of the photosensitive element at this time was set to 0.3 micrometer to 0.5 micrometer.

(3) Application of Protective Agent

The protective agent and the photosensitive element manufactured in the above manner were set in the protective-agent applying devices 2-21 to 2-24 having configuration basically as shown in FIG. 1. A pressure to press the protective agent against the brush was changed in four stages, and the protective agent was applied to the photosensitive element for 3 minutes and 10 minutes. A brush for use in this case was prepared, through electrostatic flocking, by using conductive polyesters of which average thickness was 30 micrometers and length was 2.0 millimeters. In order from the protective-agent applying devices 2-24 (pressure: 1.2 newton), 2-21 (pressure: 2.5 newton), 2-22 (pressure: 3.5 newton), and 2-23 (pressure: 4.8 newton), the pressure to press the protective agent against the brush is smaller.

(4) Measurement of Coverage of Protective Agent

The XPS analysis was performed on the photosensitive element after the protective agent was applied thereto in the same manner as that before the protective agent was applied. For the C1s spectrum, a total area of peaks (peak after application) having peak tops in the range of 290.3 electron volts to 294 electron volts (range indicated by arrows in FIG. 4) was calculated by separating wavelengths in different bonding states of carbon from each other, and a ratio (area ratio $A_t$) of the total area to the area of the wavelengths of the entire C1s spectrum was calculated by using $((A_0-A_t)/A_0\times100)$ (%) to obtain the ratio. The calculation was performed randomly at five locations on each of the photosensitive elements and an average value was calculated. The results are shown in Table 4.

TABLE 4

| | | Coverage (%) | |
|---|---|---|---|
| | Protective-agent applying device | Applied for 3 minutes | Applied for 10 minutes |
| Example 2-1 | Protective-agent applying device 2-21 | 43.0 | 64.1 |
| Example 2-2 | Protective-agent applying device 2-22 | 54.5 | 79.4 |

TABLE 4-continued

| | Protective-agent applying device | Coverage (%) Applied for 3 minutes | Applied for 10 minutes |
|---|---|---|---|
| Example 2-3 | Protective-agent applying device 2-23 | 66.1 | 99.2 |
| Comparative Example 2-1 | Protective-agent applying device 2-24 | 36.2 | 54.2 |

Next, four units for each of the protective-agent applying devices 2-21 to 2-24 were set in a color MFP: imagio Neo C600 manufactured by RICOH COMPANY, LTD. which was modified so that each of the protective-agent applying devices 2-21 to 2-24 was able to be incorporated therein. A test on image formation was conducted in such a manner that an A4-size color document in horizontal orientation having an image area ratio of 4.5% was continuously printed by 5 sheets each, 5,000 sheets in total in an environment of 23° C./55% RH. It was checked whether the images were normal before and after the test was conducted, in an environment with normal-temperature and normal-humidity conditions of 20° C./50% RH, and an environment with high-temperature and high-humidity conditions of 30° C./85% RH. At this time, toner for use in the test was manufactured by a polymerization method. More specifically, the toner had a weight-average particle size (D4)=5.1 micrometers, a number-average particle size (D1)=4.4 micrometers, and a circularity SR=0.98.

High-quality images were obtained through image formation in the normal-temperature and normal-humidity environment and the high-temperature and high-humidity environment by the image forming apparatuses using the protective-agent applying devices 2-21 to 2-23. However, the images formed by the image forming apparatus using the protective-agent applying device 2-24 were found to be defective images with fine spots in all halftone images obtained in the normal-temperature and normal-humidity environment and the high-temperature and high-humidity environment.

Example 2-4 and Comparative Example 2-2

Conditions of a starting material of the protective-agent manufacturing conditions according to Example 2-1 were determined as normal paraffin of 62 wt. parts whose melting temperature was 133° C., normal paraffin of 25 wt. parts whose melting temperature was 108° C., and cyclic polyolefin TOPAS™ (softening temperature 60° C., manufactured by Ticona Co.) of 13 wt. parts. The rest of materials were the same as these in Example 2-1 to prepare a protective agent.

The protective agents of the protective-agent applying devices 2-22 and 2-23 were respectively replaced with the protective agent prepared as above, and the replaced protective agent was set in the protective-agent applying devices 2-22 and 2-23 (hereinafter, protective-agent applying devices 2-25 and 2-26, respectively). The protective-agent applying devices 2-25 and 2-26 were used to apply the protective agent in the same manner as in Example 2-1, and a protective-agent coverage was measured. The results are shown in Table 5.

TABLE 5

| | Protective-agent applying device | Coverage (%) Applied for 3 minutes | Applied for 10 minutes |
|---|---|---|---|
| Example 2-4 | Protective-agent applying device 2-26 | 43.7 | 80.1 |
| Comparative Example 2-2 | Protective-agent applying device 2-25 | 28.1 | 35.5 |

Next, four units for each of the protective-agent applying devices 2-25 and 2-26 were prepared, image forming apparatuses were manufactured by using the protective-agent applying devices 2-25 and 2-26 in the same manner as in Example 2-1, and evaluation was made on image formation. A test on the image formation was conducted in such a manner that an A4-size color document in horizontal orientation having an image area ratio of 5% was continuously printed by 5 sheets each, 7,000 sheets in total in an environment of 23° C./55% RH. It was checked whether the images were normal before and after the test was conducted, in an environment with normal-temperature and normal-humidity conditions of 20° C./50% RH, and an environment with high-temperature and high-humidity conditions of 30° C./85% RH.

When the protective-agent applying device 2-26 was used in the image forming apparatus, images with no problem for actual use were obtained in the both environments, however, fine streaks were faintly visible in the images when looked at carefully. On the other hand, when the protective-agent applying device 2-25 was used in the image forming apparatus, defective images with fine streaks could be seen in the both environments.

Examples 2-5 and 2-6

Conditions of a starting material of the protective-agent manufacturing conditions according to Example 2-1 were determined as normal paraffin of 52 wt. parts whose melting temperature was 126° C., normal paraffin of 25 wt. parts whose melting temperature was 108° C., cyclic polyolefin TOPAS™ (softening temperature 60° C., manufactured by Ticona Co.) of 13 wt. parts, and polytetrafluoroethylene particles of 10 wt. parts. The rest of materials were the same as these in Example 2-1 to prepare a protective agent.

The protective agents of the protective-agent applying devices 2-26 and 2-25 according to Example 2-4 and Comparative Example 2-2 were respectively replaced with the protective agent prepared as above, and the replaced protective agent was set in the protective-agent applying devices 2-26 and 2-25 (hereinafter, protective-agent applying devices 2-27 and 2-28, respectively). The protective-agent applying devices 2-27 and 2-28 were used to apply the protective agent in the same manner as in Example 2-1, and a protective-agent coverage was measured. The results are shown in Table 6.

TABLE 6

| | Protective-agent applying device | Coverage (%) Applied for 3 minutes | Applied for 10 minutes |
|---|---|---|---|
| Example 2-5 | Protective-agent applying device 2-27 | 46.0 | 69.8 |

TABLE 6-continued

| | Protective-agent applying device | Coverage (%) Applied for 3 minutes | Applied for 10 minutes |
|---|---|---|---|
| Example 2-6 | Protective-agent applying device 2-28 | 50.5 | 81.2 |

Next, four units for each of the protective-agent applying devices 2-27 and 2-28 were prepared, image forming apparatuses were manufactured by using the protective-agent applying devices 2-27 and 2-28 in the same manner as in Example 2-1, and evaluation was made on image formation. A test on the image formation was conducted in such a manner that an A4-size color document in horizontal orientation having an image area ratio of 5% was continuously printed by 5 sheets each, 7,000 sheets in total in an environment of 23° C./55% RH. It was checked whether the images were normal before and after the test was conducted, in an environment with normal-temperature and normal-humidity conditions of 20° C./50% RH, and an environment with high-temperature and high-humidity conditions of 30° C./85% RH. As a result, high-quality images were obtained in the both environments.

Example 2-7

Conditions of a starting material of the protective-agent manufacturing conditions according to Example 2-1 were determined as normal paraffin of 55 wt. parts whose melting temperature was 66° C., normal paraffin of 32 wt. parts whose melting temperature was 108° C., and cyclic polyolefin TOPAS™ (softening temperature 60° C., manufactured by Ticona Co.) of 13 wt. parts. The rest of materials were the same as these in Example 2-1 to prepare a protective agent.

The protective agent of the protective-agent applying device 2-22 was replaced with the protective agent prepared as above, and the replaced protective agent was set in the protective-agent applying device 2-22 (hereinafter, protective-agent applying device 2-29). The protective-agent applying device 2-29 was used to apply the protective agent in the same manner as in Example 2-2, and a protective-agent coverage was measured. The coverage was as follows: 63.8% (applied for 3 minutes) and 100.1% (applied for 10 minutes).

Next, four units of the protective-agent applying device 2-29 were prepared, image forming apparatuses were manufactured by using the four protective-agent applying devices 2-29 in the same manner as in Example 2-1, and evaluation was made on image formation. A test on the image formation was conducted in such a manner that an A4-size color document in horizontal orientation having an image area ratio of 7% was continuously printed by 5 sheets each, 4,000 sheets in total in an environment of 28° C./55% RH. It was checked whether the images were normal before and after the test was conducted, in an environment with normal-temperature and normal-humidity conditions of 20° C./50% RH, and an environment with high-temperature and high-humidity conditions of 30° C./85% RH. As a result, images with no problem for actual use were obtained, however, fine uneven shading was faintly visible in the images when looked at carefully.

Example 2-8

A protective agent is prepared with a normal paraffin whose melting temperature was 74° C. instead of normal paraffin whose melting temperature was 66° C. of the protective-agent manufacturing conditions in Example 2-7. The rest of materials were the same as these in Example 2-7.

The protective agent of the protective-agent applying device 2-29 was replaced with the protective agent prepared as above, and the replaced protective agent was set in the protective-agent applying device 2-29 (hereinafter, a protective-agent applying device 2-30). The protective-agent applying device 2-30 was used to apply the protective agent in the same manner as in Example 2-1, and a protective-agent coverage was measured. The coverage was as follows: 59.0% (applied for 3 minutes) and 89.9% (applied for 10 minutes).

Next, four units of the protective-agent applying device 2-30 were prepared, image forming apparatuses were manufactured by using the protective-agent applying devices 2-30 in the same manner as in Example 2-1, and evaluation was made on image formation. A test on the image formation was conducted in such a manner that an A4-size color document in horizontal orientation having an image area ratio of 7% was continuously printed by 5 sheets each, 4,000 sheets in total in an environment of 28° C./55% RH. It was checked whether the images were normal before and after the test was conducted, in an environment with normal-temperature and normal-humidity conditions of 20° C./50% RH, and an environment with high-temperature and high-humidity conditions of 30° C./85% RH. As a result, images with no problem for actual use were obtained.

Comparative Example 2-3

A protective-agent applying device 2-31 is prepared with a brush which had the same specification as the brush used for the protective-agent applying device 2-21 and of which manufacturing lot was manufactured five month ago. The rest of materials were the same as these of the protective-agent applying device 2-21. The protective-agent applying device 2-31 was used to apply the protective agent in the same manner as in Example 2-1, and a protective-agent coverage was measured. The protective-agent coverage was as follows: 36.8% (applied for 3 minutes) and 56.8% (applied for 10 minutes).

Next, four units of the protective-agent applying device 2-31 were prepared, image forming apparatuses were manufactured in the same manner as in Example 2-1 except for using the four protective-agent applying devices 2-31, and a test on the image formation was conducted in the same manner as in Example 2-1. As a result, defective images with fine spots could be seen in all halftone images obtained in both the normal-temperature and normal-humidity environment and the high-temperature and high-humidity environment.

Explained below is a third embodiment of the present invention. A protective-agent applying device of the third embodiment is of configuration basically the same as previously described in connection with FIG. 1. An image carrier as a photosensitive element and toner used in the third embodiment are the same as these of the first embodiment.

FIG. 4 depicts the C1s spectrum obtained by the XPS analysis of the photosensitive element according to the third embodiment.

Method of Manufacturing Protective-Agent Bar No. 1

FT 115 (synthetic wax manufactured by NIPPON SEIRO CO., LTD.) of 95 wt. parts and 10 wt. parts of TOPAS™ (manufactured by Ticona Co.) were put into a glass container with a lid, and stirred and melted by a hot stirrer in which temperature was controlled to 160° C. to 250° C.

The stirred and melted protective agent was poured into an aluminum-made die having previously been heated to 115° C.

to be filled therewith. The die had inner dimensions of 12 mm×8 mm×350 mm. The protective agent was cooled down to 88° C. on a wooden bench, and then was further cooled down to 40° C. on an aluminum bench. Thereafter, a solid matter was removed from the die and cooled down to a room temperature while a weight was put on the solid matter to prevent warpage.

After cooled down, both ends of the solid matter in the longitudinal direction were cut, and the bottom thereof was cut to prepare a protective-agent bar No. 1 of 7 mm×8 mm×310 mm. A double-stick tape was adhered to the bottom of the protective-agent bar, and the protective-agent bar was fixed to a metal support.

Method of Manufacturing Protective-Agent Bar No. 2

FT 115 (synthetic wax manufactured by NIPPON SEIRO CO., LTD.) of 55 wt. parts, 25 wt. parts of sorbitan tristearate (hydrophile-lipophile balance (HLB): 1.5), and 20 wt. parts of normal paraffin (average molecular weight 640) were put into a glass container with a lid, and stirred and melted by a hot stirrer in which temperature was controlled to 180° C.

The stirred and melted protective agent was poured into an aluminum-made die having previously been heated to 115° C. to be filled therewith. The die had inner dimensions of 12 mm×8 mm×350 mm. The protective agent was cooled down to 90° C. on a wooden bench, and then was further cooled down to 40° C. on an aluminum bench. Thereafter, a solid matter was removed from the die and cooled down to a room temperature while a weight was put on the solid matter to prevent warpage.

After cooled down, both ends of the solid matter in the longitudinal direction were cut, and the bottom thereof was cut to prepare a protective-agent bar No. 2 of 7 mm×8 mm×310 mm. A double-stick tape was adhered to the bottom of the protective-agent bar, and the protective-agent bar was fixed to a metal support.

Next, a protective agent is applied by the protective-agent applying device.

An evaluation method of the protective-agent applying device is implemented as follows. When a predetermined threshold is set to 50% and ($A/A_0 \times 100$) (%) upon application of the protective agent for 10 minutes becomes a threshold of 50% or less, then the protective-agent applying device is determined as acceptable. As explained above, "A" indicates an area ratio of an area of peaks to a peak area in an entire C1s spectrum. Specifically, the peaks are obtained by separating wavelengths in different bonding states of carbon in a range of 290.3 electron volts to 294 electron volts for the C1s spectrum detected when the XPS analysis is performed on the surface of the photosensitive element. Additionally, "$A_0$" indicates an area ratio before the protective agent is applied, and A is an area ratio after the protective agent is applied.

Example 3-1

A photosensitive element No. 1, an applying brush No. 2 (10 d, 50K), and an urethane blade were set in the protective-agent applying device 2. The protective-agent bar No. 1 was pressed against the applying brush with a spring pressure of 5 newton, and the protective agent was applied to the photosensitive element for 10 minutes. The linear velocity of the photosensitive element was 125 mm/s and the linear velocity of the applying brush was 146 mm/s (Condition 1 for the protective-agent applying device).

As a result of the XPS analysis of the photosensitive element after the protective agent was applied thereto, a ratio (A) of a total area of peaks to an area of the entire C1s spectrum was 2.4%. Specifically, the peaks were detected in the range of 290.3 electron volts to 294 electron volts (peak top) in the C1s spectrum obtained by the analysis. Therefore, a ratio ($A/A_0 \times 100$) (%) of A after the protective agent was applied, to $A_0$ (6.9%) before the protective agent was applied was 35%, and thus the protective-agent applying device based on the condition 1 was determined as acceptable.

Example 3-2

A photosensitive element No. 2, an applying brush No. 3 (20 d, 50K), and an urethane blade were set in the protective-agent applying device 2. The protective-agent bar No. 2 was pressed against the applying brush with a spring pressure of 3 newton, and the protective agent was applied to the photosensitive element for 10 minutes. The linear velocity of the photosensitive element was 125 mm/s and the linear velocity of the applying brush was 146 mm/s (Condition 2 for the protective-agent applying device).

As a result of the XPS analysis of the photosensitive element after the protective agent was applied thereto, a ratio (A) of a total area of peaks to an area of the entire C1s spectrum was 3.0%. Specifically, the peaks were detected in the range of 290.3 electron volts to 294 electron volts (peak top) in the C1s spectrum obtained by the analysis. Therefore, a ratio ($A/A_0 \times 100$) (%) of A after the protective agent was applied, to $A_0$ (7.0%) before the protective agent was applied was 43%, and thus the protective-agent applying device based on the condition 2 was determined as acceptable.

Example 3-3

A photosensitive element No. 3, an applying brush No. 1 (10 d, 30K), and an urethane blade were set in the protective-agent applying device 2. The protective-agent bar No. 1 was pressed against the applying brush with a spring pressure of 4 newton, and the protective agent was applied to the photosensitive element for 10 minutes. The linear velocity of the photosensitive element was 125 mm/s and the linear velocity of the applying brush was 146 mm/s (Condition 3 for the protective-agent applying device).

As a result of the XPS analysis of the photosensitive element after the protective agent was applied thereto, a ratio (A) of a total area of peaks to an area of the entire C1s spectrum was 6.1%. Specifically, the peaks were detected in the range of 290.3 electron volts to 294 electron volts (peak top) in the C1s spectrum obtained by the analysis. Therefore, a ratio ($A/A_0 \times 100$) (%) of A after the protective agent was applied, to $A_0$ (6.8%) before the protective agent was applied was 89%, and thus the protective-agent applying device based on the condition 3 was determined as unacceptable.

Example 3-4

A photosensitive element No. 4, the applying brush No. 2 (10 d, 50K), and an urethane blade were set in the protective-agent applying device 2. The protective-agent bar No. 2 was pressed against the applying brush with a spring pressure of 4.8 newton, and the protective agent was applied to the photosensitive element for 10 minutes. The linear velocity of the photosensitive element was 125 mm/s and the linear velocity of the applying brush was 146 mm/s (Condition 4 for the protective-agent applying device).

As a result of the XPS analysis of the photosensitive element after the protective agent was applied thereto, a ratio (A) of a total area of peaks to an area of the entire C1s spectrum was 1.1%. Specifically the peaks were detected in the range of 290.3 electron volts to 294 electron volts (peak top) in the C1s spectrum obtained by the analysis. Therefore, a ratio ($A/A_0 \times 100$) (%) of A after the protective agent was applied, to $A_0$ (7.4%) before the protective agent was applied was 15%, and thus the protective-agent applying device based on the condition 4 was determined as acceptable.

Example 3-5

A photosensitive element No. 5, the applying brush No. 3 (20 d, 50K), and an urethane blade as the cleaning device 4 were set in the protective-agent applying device 2. The protective-agent bar No. 1 was pressed against the applying brush with a spring pressure of 4.8 newton, and the protective agent was applied to the photosensitive element for 10 minutes. The linear velocity of the photosensitive element was 125 mm/s and the linear velocity of the applying brush was 146 mm/s (Condition 5 for the protective-agent applying device).

As a result of the XPS analysis of the photosensitive element after the protective agent was applied thereto, a ratio (A) of a total area of peaks to an area of the entire C1s spectrum was 5.1%. Specifically the peaks were detected in the range of 290.3 electron volts to 294 electron volts (peak top) in the C1s spectrum obtained by the analysis. Therefore, a ratio ($A/A_0 \times 100$) (%) of A after the protective agent was applied, to $A_0$ (6.4%) before the protective agent was applied was 79%, and thus the protective-agent applying device based on the condition 5 was determined as unacceptable.

In the C1s spectrums obtained by the XPS analysis of the photosensitive elements after the respective protective agents were applied according to Examples 3-1 to 3-5, the peaks seen in the range of 290.3 electron volts to 294 electron volts (peak top) did not overlap bottoms of the peaks in the range of 290.3 electron volts (peak top) or less and in the range of 294 electron volts (peak top) or more. Therefore, the areas were calculated by determining wavelengths seen in the range of 290.3 electron volts to 294 electron volts (peak top) as a block of area.

Evaluation was made on the photosensitive elements No. 1 and No. 3 used in the Example 3-1 and 3-3 respectively which were set in photosensitive element units for black and cyan, specifically, IPSiO CX400 (tandem-type color image forming apparatus: manufactured by RICOH COMPANY, LTD.) in the following manner. Charging rollers were provided right above the photosensitive elements, and each of the charging rollers was pressed against the photosensitive element with the spring the same as that of Examples 3-1 and 3-3, the linear velocity of the photosensitive element was 125 mm/sec, and an alternating voltage having a frequency of 1450 Hertz and an amplitude of 1100 volts was superimposed on a direct current voltage of −600 volt to be applied between the photosensitive element and the charging roller. The applying brush No. 2 and the urethane blade 4 were set in the photosensitive element unit for black so that the condition would be the same as the condition 1, while the applying brush No. 1 and the urethane blade 4 were set in the photosensitive element unit for cyan so that the condition would be the same as the condition 3.

Figure 5:
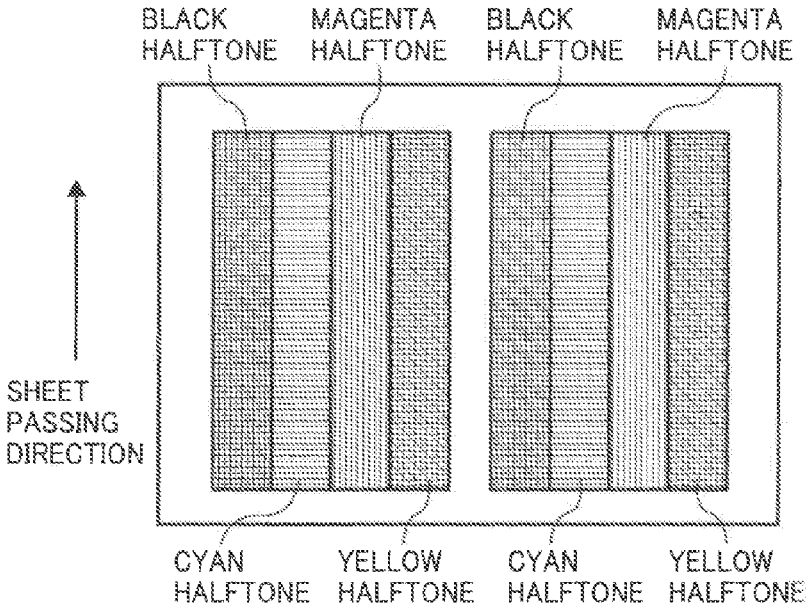
FIG. 5 is image patterns used for experiments on evaluation.

FIG. 5 is image patterns used for the experiments.

The image in FIG. 5 is obtained by repeating a pattern twice so that two patterns are sequentially arranged, each of the patterns having 1-by-1 halftone images for four colors including black. Evaluation was made on the black unit and the cyan unit by outputting an A4-size 1-by-1 halftone image as shown in FIG. 5 by 5 sheets. As a result, high-quality images were output from the black unit and the cyan unit.

Subsequently, by using the black and cyan units, an A4-size 1-by-1 halftone image as shown in FIG. 5 was output by 5 sheets each, 7,000 sheets in total. As a result, high-quality images were output from the black unit, while images with white streaks were output from the cyan unit.

As set forth herein above, according to an embodiment of the present invention, it is possible to form high-quality images by efficiently supplying protective agent to a photosensitive element.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A protective-agent applying device comprising:

an applying unit that applies a protective agent containing paraffin to a surface of a photosensitive element in such a manner that when applying the protective agent for 10 minutes, the protective agent equal to or more than 0.5 $\mu g/cm^2$ adheres to the surface, and when applying the protective agent for 60 minutes, the protective agent equal to or less than 8 $\mu g/cm^2$ adheres to the surface, wherein the protective agent contains 40 percent or more by weight of paraffin, a melting point of the paraffin being in a range of 70° C. to 130° C., the applying unit is a brush having brush fibers planted on a core metal, the brush fibers having a diameter of 10 to 500 μm, a length of 1 to 15 mm, and a density of 10,000 to 300,000 lines per square inch, and the brush is configured to apply the protective agent to the surface of the photosensitive element in such a manner that when applying the protective agent for time t, a coverage of the protective agent with respect to the photosensitive element is equal to or more than a predetermined value, the predetermined value being 40% when the time is 3 minutes and the predetermined value being 60% when the time is 10 minutes, the coverage being $(A_0-A_t)/A_0 \times 100(\%)$ where $A_0$ is a ratio of a sum of areas of first peaks having peak tops in a range of 290.3 electron volts to 294 electron volts to an area of an entire C1s spectrum, and $A_t$ is a ratio of a sum of areas of second peaks having peak tops in the range of 290.3 electron volts to 294 electron volts to an area of the entire C1s spectrum after the protective agent is applied, the first peaks being obtained by separating wavelengths caused by different bonding states of carbon according to binding energy in the C1s spectrum obtained by X-ray photoelectron spectroscopy analysis of the surface of the photosensitive element in initial state, and the second peaks being obtained by separating wavelengths caused by different bonding states of carbon according to binding energy in the C1s spectrum obtained by X-ray photoelectron spectroscopy analysis of the surface of the photosensitive element after the protective agent is applied for the time t.

2. The protective-agent applying device according to claim 1, wherein the applying unit includes a bar formed of the protective agent;

said brush rotates in contact with the surface of the photosensitive element to apply the protective agent from the bar to the surface; and a blade that evens out the protective agent on the surface of the photosensitive element.

3. The protective-agent applying device according to claim 1, wherein the protective agent contains 0.1 percent or less of a metal element.

4. The protective-agent applying device according to claim 1, wherein the protective agent contains 50 percent or more by weight of paraffin.

5. The protective-agent applying device according to claim 1, wherein the applying unit is configured to apply the protective agent prepared such that a sum of areas of the first peaks having peak tops in a range of 290.3 electron volts to 294 electron volts is 1 percent or less of an area of an entire C1s spectrum, the first peaks being obtained by separating wavelengths caused by different bonding states of carbon according to binding energy in the C1s spectrum obtained by X-ray photoelectron spectroscopy analysis of the protective agent.

6. A process cartridge comprising:

a protective-agent applying device that includes an applying unit that applies a protective agent containing paraffin to a surface of a photosensitive element in such a manner that when applying the protective agent for 10 minutes, the protective agent equal to or more than 0.5 $\mu g/cm^2$ adheres to the surface, and when applying the protective agent for 60 minutes, the protective agent equal to or less than 8 $\mu g/cm^2$ adheres to the surface, wherein the protective agent contains 40 percent or more by weight of paraffin, a melting point of the paraffin being in a range of 70° C. to 130° C., the applying unit is a brush having brush fibers planted on a core metal, the brush fibers having a diameter of 10 to 500 μm, a length of 1 to 15 mm, and a density of 10,000 to 300,000 lines per square inch, and the brush is configured to apply the protective agent to the surface of the photosensitive element in such a manner that when applying the protective agent for time t, a coverage of the protective agent with respect to the photosensitive element is equal to or more than a predetermined value, the predetermined value being 40% when the time is 3 minutes and the predetermined value being 60% when the time is 10 minutes, the coverage being $(A_0-A_t)/A_0\times100(\%)$ where $A_0$ is a ratio of a sum of areas of first peaks having peak tops in a range of 290.3 electron volts to 294 electron volts to an area of an entire C1s spectrum, and $A_t$ is a ratio of a sum of areas of second peaks having peak tops in the range of 290.3 electron volts to 294 electron volts to an area of the entire C1s spectrum after the protective agent is applied, the first peaks being obtained by separating wavelengths caused by different bonding states of carbon according to binding energy in the C1s spectrum obtained by X-ray photoelectron spectroscopy analysis of the surface of the photosensitive element in initial state, and the second peaks being obtained by separating wavelengths caused by different bonding states of carbon according to binding energy in the C1s spectrum obtained by X-ray photoelectron spectroscopy analysis of the surface of the photosensitive element after the protective agent is applied for the time t.

7. An image forming apparatus comprising:

a protective-agent applying device that includes an applying unit that applies a protective agent containing paraffin to a surface of a photosensitive element in such a manner that when applying the protective agent for 10 minutes, the protective agent equal to or more than 0.5 $\mu g/cm^2$ adheres to the surface, and when applying the protective agent for 60 minutes, the protective agent equal to or less than 8 $\mu g/cm^2$ adheres to the surface, wherein the protective agent contains 40 percent or more by weight of paraffin, a melting point of the paraffin being in a range of 70° C. to 130° C., the applying unit is a brush having brush fibers planted on a core metal, the brush fibers having a diameter of 10 to 500 μm, a length of 1 to 15 mm, and a density of 10,000 to 300,000 lines per square inch, and the brush is configured to apply the protective agent to the surface of the photosensitive element in such a manner that when applying the protective agent for time t, a coverage of the protective agent with respect to the photosensitive element is equal to or more than a predetermined value, the predetermined value being 40% when the time is 3 minutes and the predetermined value being 60% when the time is 10 minutes, the coverage being $(A_0-A_t)/A_0\times100(\%)$ where $A_0$ is a ratio of a sum of areas of first peaks having peak tops in a range of 290.3 electron volts to 294 electron volts to an area of an entire C1s spectrum, and $A_t$ is a ratio of a sum of areas of second peaks having peak tops in the range of 290.3 electron volts to 294 electron volts to an area of the entire C1s spectrum after the protective agent is applied, the first peaks being obtained by separating wavelengths caused by different bonding states of carbon according to binding energy in the C1s spectrum obtained by X-ray photoelectron spectroscopy analysis of the surface of the photosensitive element in initial state, and the second peaks being obtained by separating wavelengths caused by different bonding states of carbon according to binding energy in the C1s spectrum obtained by X-ray photoelectron spectroscopy analysis of the surface of the photosensitive element after the protective agent is applied for the time t.

8. The image forming apparatus according to claim 7 further comprising a process cartridge that includes the protective-agent applying device.

9. The image forming apparatus according to claim 1, further comprising:

a protective layer forming blade configured to form a protective layer on the surface of the photosensitive element having the protective agent applied thereto.

* * * * *